US011486048B2

(12) United States Patent
Brodskyy et al.

(10) Patent No.: US 11,486,048 B2
(45) Date of Patent: Nov. 1, 2022

(54) METHOD AND APPARATUS FOR ELECTROLYTIC REDUCTION OF FEEDSTOCK ELEMENTS, MADE FROM FEEDSTOCK, IN A MELT

(71) Applicants: Velta Holdings US Inc., Wilmington, DE (US); RD Titan Group, TOV, Solonka (UA)

(72) Inventors: Andriy Brodskyy, Dnipro (UA); Viktor Troshchylo, Dnipro (UA); Andrii Gonchar, Solonka (UA); Oleksandr Chukhmanov, Zaporizhia (UA); Roman Romanov, Kamianske (UA)

(73) Assignees: Velta Holdings US Inc., Claymont, DE (US); RD Titan Group, TOV, Solonka (UA)

( * ) Notice: Subject to any disclaimer, the term of this patent is extended or adjusted under 35 U.S.C. 154(b) by 435 days.

(21) Appl. No.: 16/783,885

(22) Filed: Feb. 6, 2020

(65) Prior Publication Data

US 2021/0246564 A1 Aug. 12, 2021

(51) Int. Cl.
*C25C 1/00* (2006.01)
*C25C 3/00* (2006.01)
(Continued)

(52) U.S. Cl.
CPC ..... *C25C 3/28* (2013.01); *C25C 7/025* (2013.01); *C25C 7/06* (2013.01)

(58) Field of Classification Search
CPC .. C25C 3/00; C25C 3/28; C25C 7/005; C25C 1/00; C25C 7/02; C25C 7/025
See application file for complete search history.

(56) References Cited

U.S. PATENT DOCUMENTS

2012/0156492 A1* 6/2012 Dudley ..... C25C 3/28 205/560
2012/0160699 A1* 6/2012 Dudley ..... C22B 5/02 204/244
2013/0299341 A1* 11/2013 Dudley ..... C25C 7/005 204/243.1

OTHER PUBLICATIONS

Asuzuki, R.O. et al., "Calciothermic Reduction and Simultaneous Electrolysis of CaO in the Molten CaC12: Some Modifications of OS Process", Proceedings of 1st International Round Table on Titanium Production in Molten Salts, Mar. 2008, pp. 20-26.

(Continued)

*Primary Examiner* — Zulmariam Mendez
(74) *Attorney, Agent, or Firm* — Warner Norcross + Judd LLP

(57) ABSTRACT

The present invention pertains to a method for electrolytic reduction of feedstock elements, made from feedstock, in a melt. In addition, the present invention relates to an apparatus for electrolytic reduction of feedstock elements, made from feedstock, and can be used for the reduction of oxides of metals belonging to Groups 3-14 of the Periodic Table. The method is implemented using the apparatus that, according to the invention, comprises an electrolyzer bath; an electrolytic cell; an electrolyzer bath insert plate; a cover with evolved gas outlets. Moreover, the electrolytic cell contains at least one cathode chamber and two anode plates, which are vertically arranged relative to each other, at least one current source, independently connected to the cathode chamber and one or two anode plates, and a device for horizontal reciprocating movement of the said electrolytic cell, which is found outside of the electrolyzer cover.

11 Claims, 31 Drawing Sheets

(51) Int. Cl.

| | |
|---|---|
| ***C25C 7/02*** | (2006.01) |
| ***C25C 3/28*** | (2006.01) |
| ***C25C 7/06*** | (2006.01) |

(56) References Cited

OTHER PUBLICATIONS

Zaikov, Y.P. et al., "Calcium Production by the Electrolysis of Molten CaCI2—Part I. Interaction of Calcium and Copper-Calcium Alloy with Electrolyte", Metallurgical and Materials Transactions B, vol. 45B, Jun. 2014, pp. 961-967.

* cited by examiner

METHOD AND APPARATUS FOR ELECTROLYTIC REDUCTION OF FEEDSTOCK ELEMENTS, MADE FROM FEEDSTOCK, IN A MELT

FIELD OF INVENTION

The present invention relates to a method for electrolytic reduction of feedstock elements, made from feedstock, in a melt. In addition, the present invention relates to an apparatus for electrolytic reduction of feedstock elements, made from feedstock, and can be used for the reduction of oxides of metals belonging to Groups 3-14 of the Periodic Table, which include, but are not limited to, for example, Ti, Zr, Hf, V, Nb, Ta, Cr, Mo, W, in order to obtain oxides of these metals with a lower oxidation state, or pure metals of the specified groups with zero oxidation state, or alloys of metals of these groups with various dopants, for example, but not limited to TiNi, TiAl.

BACKGROUND TO THE INVENTION

International Patent Application WO/1999/064638 (Publication Date: Dec. 16, 1999) describes a method for removing oxygen from metals and metal oxides by electrolytic reduction. The method involves electrolysis of an oxide in molten salt. The electrolysis is conducted under conditions such that reaction of oxygen rather than deposition of a salt cation occurs at an electrode surface, and that oxygen dissolves in the electrolyte. The metal oxide or metalloid oxide being reduced is in the form of a solid sintered cathode. The disadvantage of this method is that, when there is a deficiency of $O^{2-}$ ions in the melt, the release of chloride anions on the anode is the main anode reaction at the initial stage of electrolysis, which is a negative factor, since the chlorine released as a result affects the service life of the apparatus for reduction. An increase in the concentration of $O^{2-}$ ions leads to an increase in the number of contaminating reactions, for example, absorption of $CO_2$ released during electrolysis when using graphite as the anode material, and its subsequent reduction on the cathode to carbon, which reduces the efficiency of electric current consumption and also leads to contamination of the material being reduced, with carbon. Thus, in order to achieve an increase in the number of $O^{2-}$ ions in the melt without a significant increase in their concentration, one has to increase the amount of the melt relative to the material being reduced, which leads to an increase in the size of the electrolyzer, which is of some difficulty when trying to implement this process on an industrial scale.

Another disadvantage of the described process is that in the melt in the presence of an active ingredient, for example, CaO, the ion of the active ingredient is reduced at the cathode, for example, $Ca^{2+}$ to $Ca^{+}$ or $Ca^{2+}$ to $Ca^{0}$, which can then be delivered to the anode by convective flows, where the charge exchange will occur according to the following chemical reactions:

$$Ca^{+}-e=Ca^{2+} \quad (1)$$

$$Ca^{0}-2e=Ca^{2+} \quad (2),$$

which also contributes to the loss of current efficiency. Since the Ca formed during the reduction process is soluble in $CaCl_2$, potentials slightly lower than the electrolyte decomposition potential will lead to the formation of a small amount of Ca dissolved in the electrolyte, leading to a certain degree of electronic conductivity in the electrolyte, which also reduces current efficiency.

International Patent Application WO/2010/146369 (Publication Date: Dec. 23, 2010) describes a method for producing a metal element from solid metal oxide feedstock, having a three-dimensional shape, which comprises steps of forming a solid metal oxide feedstock, wherein the solid feedstock comprises a plurality of elements which are packed randomly, and in the volume of the feedstock, free space without taking into account the microscopic porosity of these elements is from 35 to 90 vol. %; the feedstock is placed inside the apparatus for reduction and the feedstock is reduced to metal, while during the reduction process, the feedstock elements substantially retain their shape. Disadvantageously, when the elements to be reduced are packed randomly, there is a greater likelihood that not all the elements being reduced will be reduced to the required level and there will be a significant spread in the values of residual oxygen between different elements. This phenomenon can be caused by the deposition of the active ingredient, for example, CaO, on the surface of the elements, the imperfect and uneven flow path of the melt through the elements during the reduction process, poor contact of the elements with current-carrying parts of the cathode chamber, which reduces the efficiency of direct reduction.

WO/2010/146369 also describes that if the rate of oxygen dissolution from the feedstock is too high, the concentration of CaO in the melt near the feedstock may rise above the solubility limit of CaO and $CaCl_2$, and CaO can be deposited in the melt. If this occurs in the proximity of the feedstock, the deposited solid CaO may prevent further dissolution of oxygen from the feedstock and stop the reduction process. Therefore, this application proposes a gradual increase in the current potential of the electrolytic cell at the beginning of the process to reduce a portion of feedstock, from low voltage to maximum, so as to limit the rate of oxygen dissolution and to avoid CaO deposition. Disadvantageously, the melt flow through the elements is insufficient to prevent the increase of CaO concentration near the feedstock up to the solubility limit levels. Another disadvantage is that there is no removal of CaO rich melt from the feedstock, which increases the reaction time and, as a result, reduces current efficiency due to the increase in the duration of competing contaminating reactions described above.

International Patent Application WO/2012/066297 (Publication Date: May 24, 2012) describes a removable electrode module for engagement with an electrolysis chamber, including a first electrode, a second electrode and a suspension structure. The suspension structure comprises a suspension rod coupled to the first electrode. The second electrode is suspended or supported by the suspension structure, which comprises at least one electrically-insulating spacer element for retaining the second electrode in spatial separation from the first electrode. The disadvantages are the complexity of the design, which requires a lot of efforts for its assembly and unloading of the elements after electrolysis, poor reliability due to the complicated design, for example, many elements are made of ceramics, which is subject to accelerated wear during temperature changes. It should also be noted that there is no possibility of additional vertical or horizontal movement of the entire cell during the reduction process to lower the concentration of CaO near the feedstock.

International Patent Application WO/2010/130995 (Publication Date: Nov. 18, 2010) describes a method for reducing a solid feedstock, such as a solid metal compound, in which the feedstock is arranged on upper surfaces of elements in a bipolar cell stack contained within a housing. A molten salt electrolyte is circulated through the housing so that it contacts the elements of the bipolar stack and the feedstock. A potential is applied to terminal electrodes of the bipolar stack such that the upper surfaces of the elements become cathodic and the lower surfaces of the elements become anodic.

The disadvantage of this method lies in the difficulty of controlling the current potential over each element of the bipolar cell, that is, there is a high probability that a given potential will not be brought to each of the elements comprising the cell. It should also be noted that there is no possibility of additional vertical or horizontal movement of the entire cell during the reduction process to lower the concentration of CaO near the feedstock. A second aspect of Application WO/2010/130995 provides an apparatus for the reduction of a solid feedstock, for example, for the production of metal by reduction of the solid feedstock, the apparatus comprising a housing having a molten salt inlet and a molten salt outlet, and a bipolar cell stack located within the housing. The bipolar cell stack comprises a terminal anode positioned in an upper portion of the housing, a terminal cathode positioned in a lower portion of the housing, and one or more bipolar elements vertically spaced from each other between the anode and cathode. An upper surface of each bipolar element, and an upper surface of the terminal cathode are capable of supporting a portion of the solid feedstock. The disadvantage of this, when implementing the scheme, proposed in the said application, including pumping the molten salt, is that the gases released on the anode part of the first bipolar element will come into contact with the cathode part of the same element and the reduced feedstock elements of all subsequent cathode parts of bipolar elements. If this is $CO_2$ when using graphite as the material for the anode part of the bipolar element, this will lead to the reduction of dissolved $CO_2$ to carbon on cathode parts of the bipolar element. If it is $O_2$ when using an inert material, for example, $CaTiO_3$ or $CaRuO_3$ as the material for the anode part of the bipolar element, this will lead to oxidation and significant decrease in service life of the cathode parts of the bipolar element, as well as to the oxidation of the reduced feedstock elements and, as a result, to a significant increase in the electric current consumption for reduction, and to an increase in the reduction time, which in general leads to a decrease in current efficiency of the reduction process. In addition, the proposed design does not allow uniform flow of the melt through the bath, which can result in the pumped melt flowing through the zones of least resistance, and stagnation zones with insufficient melt exchange will form, in which the concentration of CaO can significantly increase up to saturation limits, which will lead to CaO crystallization and a slowdown in the feedstock reduction process in the zones where CaO crystallization occurs.

International Patent Application WO/2003/038156 (Publication Date: May 8, 2003) describes a method and an apparatus for smelting titanium metal by thermal reduction of titanium oxide ($TiO_2$) to titanium metal (Ti); a mixed salt of calcium chloride ($CaCl_2$) and calcium oxide (CaO) contained in a reaction vessel is heated to form a molten salt which constitutes a reaction region, the molten salt in the reaction region is electrolyzed thereby converting the molten salt into a strongly reducing molten salt containing monovalent calcium ions (Cat) and/or calcium (Ca), titanium oxide is supplied to the strongly reducing molten salt and the titanium oxide is reduced and the resulting titanium metal is deoxidized by the monovalent calcium ions and/or calcium.

The disadvantage of this method is that in this case direct reduction, which is only possible during direct contact of the element being reduced with the cathode, does not occur. Reduction occurs only due to indirect reduction upon contact of the reduced ions of calcium, which is the active ingredient dissolved in the melt, with the $TiO_2$ being reduced. In this case, the concentration of calcium ions at different distances from the cathode will be different, namely, the maximum concentration will be observed in close proximity to the cathode and will decrease with distance from the cathode. Thus, the rate of $TiO_2$ reduction to a metal will vary depending on the distance of the $TiO_2$ being reduced from the cathode: the farther $TiO_2$ is from the cathode, the lower the completeness of reduction and the more time will be required for complete deoxidation of $TiO_2$ in comparison with $TiO_2$ located in close proximity to the cathode.

The concentration of $Ca^+$ or $Ca^0$ at the cathode and in the melt volume has different values; as a result, this causes the reduction of $TiO_2$ at the cathode and away from it to proceed at different rates.

Another disadvantage of the described process is that the active ingredient ion is reduced at the cathode in the melt in the presence of CaO, i.e., $Ca^{2+}$ is reduced to $Ca^+$, or $Ca^{2+}$ to $Ca^0$, which can then be delivered to the anode by convective flows, where the charge exchange will occur according to chemical reactions (1) and (2), which also reduces current efficiency. Since calcium metal formed during the reduction process is soluble in $CaCl_2$, potentials slightly lower than the electrolyte decomposition potential will lead to the formation of a small amount of calcium metal dissolved in the electrolyte, leading to a certain degree of electronic conductivity in the electrolyte, which also reduces current efficiency.

One more disadvantage is that with the increase in concentration of reduced calcium in order to intensify the process, the solubility of CO2 released at the graphite anode increases, which, in turn, leads to the reduction of dissolved CO2 to C at the cathode according to the following reaction:

$$3Ca+CO_3^{2-}=3CaO+C \quad (3)$$

Also, CO2 or CO released at the graphite anode can react directly with reduced calcium according to the following reactions:

$$2Ca+CO_2(gas)=2CaO+C \quad (4)$$

$$Ca+CO(gas)=CaO+C \quad (5)$$

These are contaminating reactions which reduce current efficiency of the process, and also lead to contamination of the reduced titanium with carbon (the three reactions (3), (4), (5) mentioned above are derived from Calciothermic Reduction and Simultaneous Electrolysis of CaO in the Molten $CaCl_2$): Some Modifications of OS Process, Suzuki, Ryosuke O, pp. 20-26, Proceedings of 1st International Round Table on Titanium Production in Molten Salts, March 2008—https://eprints.lib.hokudai.ac.jp/dspace/handle/2115/50117).

This means that in the prior art ensuring the absence of any contact of gases emitted at the anode, with the cathode chamber and the feedstock elements placed therein, is a problem.

There is also a problem of designing an apparatus and a method for reducing feedstock elements, in which the feedstock elements will be arranged in an orderly manner, which will increase the contact area of the feedstock elements with the cathode chamber in order to increase the efficiency of electron transfer from the cathode chamber to the feedstock elements during direct reduction.

There is also a problem of improving melt flow through the pores of the feedstock elements and removing the products of a reduction reaction from melt stagnation zones, both in direct and indirect reduction, as well as supplying fresh portions of the reduced active ingredient in indirect reduction.

There is also a problem of creating a reduction method in which constant monitoring of the current strength and decomposition potential would be implemented.

There is also a problem of reducing the ion of an active ingredient at the metal cathode, for example, $Ca^{2+}$ to $Ca^{+}$, or $Ca^{2+}$ to $Ca^{0}$, which can then be delivered to the anode by convective flows, where the charge exchange occurs according to chemical reactions (1) and (2), reducing current efficiency.

There is also a problem that the metal of the active ingredient formed during the reduction process, for example, Ca, is soluble in $CaCl_2$, which leads to a certain degree of electronic conductivity in the electrolyte, which also reduces current efficiency.

When using graphite as the anode material, there is also a problem in the point that part of the resulting $CO_2$ dissolves in the melt and is subsequently reduced to carbon, leading to the loss of current efficiency of the process and contamination of the cathode material with carbon.

Technical Problem

The present invention is to solve the above problems.

Therefore, the object of the present invention is to eliminate all or part of the aforementioned disadvantages by proposing a method for electrolytic reduction of feedstock elements, made from feedstock, in a melt and an apparatus for electrolytic reduction of feedstock elements, designed for the implementation of the proposed method.

Notes on Construction

The use of the terms "a", "an", "the" and similar terms in the context of describing the invention are to be construed to cover both the singular and the plural, unless otherwise indicated herein or clearly contradicted by context. The terms "containing", "having", and "comprising" are to be construed as open-ended terms (i.e., meaning "including, but not limited to") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, couplings and the like, such as "attached", "coupled", "connected" and "interconnected", refer to a relationship wherein structures are secured or attached to one another either directly or indirectly through intervening structures, as well as both moveable and rigid attachments or relationships, unless specified herein or clearly indicated by context.

The use of any and all examples or exemplary language (e.g., "such as", "designed as", "preferably", "advantageously" and "optimally") herein is intended merely to better illuminate the invention and the preferred embodiment thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

Melt is a salt heated above its melting point; it is the salt being a halide of metals belonging to Groups 1-2 of the Periodic Table, or their mixtures in various proportions, for example, calcium chloride melt ($CaCl_2$) having a temperature above the melting point of calcium chloride 775° C., or a melt of the mixture of 81 weight parts of calcium chloride ($CaCl_2$) with 19 weight parts of potassium chloride (KCl) having the temperature above 640° C., or a melt of the mixture of 31 weight parts of barium chloride ($BaCl_2$) with 48 weight parts of calcium chloride ($CaCl_2$) and with 21 weight parts of sodium chloride (NaCl), having the temperature above 430° C., but not limited to these salts and their proportions.

Active ingredient is an oxide of a metal (or a mixture of oxides of different metals) belonging to Groups 1-2 of the Periodic Table, dissolved or suspended in the melt; its cation is identical to the cation of one of the salts in the melt, for example, calcium oxide (CaO) in a melt of calcium chloride ($CaCl_2$) or calcium oxide (CaO) in a melt of a mixture of salts, for example, in a melt of a mixture of 81 weight parts of calcium chloride ($CaCl_2$) with 19 weight parts of potassium chloride (KCl); or barium oxide (BaO) in a melt of a mixture of 31 weight parts of barium chloride ($BaCl_2$) with 48 weight parts of calcium chloride ($CaCl_2$) and 21 weight parts of sodium chloride (NaCl), but not limited to these active ingredients, these salts, salt mixtures and the ratios between the constituents of salt mixtures.

Feedstock is an oxide of a metal or a mixture of oxides of metals belonging to Groups 3-14 of the Periodic Table, for example, but not limited to Ti, Zr, Hf, V, Nb, Ta, Cr, Mo, W, which undergoes reduction during electrolysis in the melt in the presence of an active ingredient.

Feedstock elements are specially processed feedstock, which is put into special geometric shape and in which the specified porosity and mechanical strength are achieved.

Final metal is the final product of the reduction process, in which the oxidation state of a cation of the final metal is either zero or lower than the oxidation state of this cation in the feedstock.

Direct reduction is the process of reducing the feedstock by direct transfer of electrons from the cathode chamber to the feedstock elements being in contact with its surfaces.

Indirect reduction is the process of reducing the active ingredient by transferring electrons to it from the cathode chamber and then reducing the feedstock by transferring electrons from the reduced active ingredient to feedstock elements.

Cathode chamber is a special chamber made of conductive material for supplying electric current to feedstock elements placed in this chamber.

Anode plate is a conducting unit immersed in the melt, designed to drain electric current during electrolysis.

Electrolytic cell represents a cathode chamber and an anode facing each other, between which there occurs the phenomenon of charge transfer by ions in the melt when an electric current is applied to the cathode chamber resulting in an electrical circuit between the cathode chamber and the anode plate.

Intermediate chamber is a chamber filled with feedstock elements and positioned between the cathode chamber and the anode. It functions as a quasi-membrane that absorbs and/or oxidizes the ions of the active ingredient metal, reduced during electrolysis, thus decreasing the number of reduced active ingredient ions entering the anode, and also reducing the electronic conductivity of the melt by bringing down the concentration of the said ions of the reduced active ingredient metal in the melt.

SUMMARY OF THE INVENTION

A first aspect of the present invention provides a method for electrolytic reduction of feedstock elements made from feedstock in a melt by electrolysis in at least one electrolytic cell (50) containing the said melt, at least one cathode chamber (20) and two anode plates (30) that are vertically arranged relative to each other, providing

- an ordered arrangement of feedstock elements (10);
- constant current supply to each of the orderly arranged feedstock elements (10) during the reduction process using at least one current source, independently connected to the cathode chamber (20) and to one or two anode plates (30);
- feed of the melt into the space between the cathode chamber (20) and the anode plates (30) and flow of the melt through the pores of the feedstock elements (10);
- supply of fresh portions of the active ingredient;
- removal of gases evolved at the anode plate (30) without their contact with the cathode chamber (20) and the feedstock elements placed (10) in it;
- main and additional heating of the indicated electrolytic cell (50);
- horizontal reciprocating movement of the electrolytic cell (50);
- simultaneous supply of fresh portions of the reduced active ingredient and removal of reaction products from stagnation zones of the melt;
- removal of reduced feedstock elements (10) under controlled conditions.

Furthermore, the electrolytic cell is additionally provided with at least one intermediate chamber without supplying electric current to it, the intermediate chamber being filled with feedstock elements and located between the cathode chamber and the anode plate.

Furthermore, the method uses an additional electrolytic cell.

In the electrolytic reduction method according to the present invention, it is preferable that the reciprocating movement of the electrolytic cell is performed at a speed of 0.1-3.0 cm/sec and with a horizontal movement period of 1-48 movements within 24 hours during the entire deoxidation process.

In addition, the reduction method is carried out with stage-by-stage control of current strength and decomposition voltage.

Preferably, the reduction of feedstock elements is carried out at a concentration in the range from 0.05 mol. % to 6.0 mol. % of the active ingredient, dissolved in the melt, for example, CaO in $CaCl_2$) melt.

In addition, feedstock containing 97.0-99.9 wt. % of metal oxide or a mixture of metal oxides, advantageously 98.0-99.9 wt. %, optimally 99.5-99.9 wt. % is used for the formation of feedstock elements.

In addition, the particle sizes of the feedstock used to form feedstock elements to be reduced fall within the range of 0.1-100.0 μm, advantageously 10.0-90.0 μm, or further preferably 15.0-60.0 μm.

Preferably, feedstock elements shaped as hollow cylinders with round or oval cross section, or tubes with triangular or rectangular, or square cross section are used.

Furthermore, feedstock elements have length between 1 and 100 mm, advantageously between 10 and 90 mm, or further preferably between 25 and 50 mm.

In addition, wall thickness of feedstock elements is 1-25 mm.

It is preferable that feedstock elements with a wall thickness of 1-8 mm have a wall porosity of 20-70 vol. %, advantageously 40-70 vol. %, optimally 55-65 vol. %, and feedstock elements with a wall thickness of 9-25 mm have a porosity of 55-85 vol. %, advantageously 60-80 vol. %, optimally 65-75 vol. %.

A second aspect of the present invention provides an apparatus for electrolytic reduction of feedstock elements, made from feedstock; the apparatus comprising: an electrolyzer bath, the lower part of which contains pipelines for supplying molten salts, hot or cold argon, and the upper part of the said bath contains molten salt outlets, and hot or cold argon inlet; an electrolytic cell mounted in a supporting frame; electrolyzer bath insert plate; a cover with exhaust gas outlets. The novelty of the present invention lies in the fact that the electrolytic cell contains: at least one cathode chamber and two anode plates that are vertically arranged relative to each other, the cathode chamber being designed as an open type plate with stiffeners and containing a number of suspension rods installed for an ordered arrangement of feedstock elements; the suspension rods providing constant current supply to each of the orderly arranged feedstock elements during the reduction process; the cathode chamber being located between the anode plates; at least one current source, independently connected to the cathode chamber and to one or two anode plates; and a device for horizontal reciprocating movement of the said electrolytic cell, which is located outside the electrolyzer cover.

In addition, the cathode chamber and the anode plate are fixed in the upper part of the supporting frame by means of current-conducting strips of the claimed design.

Furthermore, the suspension rods of the cathode chamber are located at an angle of 90° to the cathode chamber surface.

In addition, the feedstock elements are fixed to the suspension rods by means of fixing brackets.

It is preferable that the electrolytic cell is further provided with at least one intermediate chamber filled with feedstock elements and located between the cathode chamber and the anode plate.

Advantages of the present invention over existing technology.

In the proposed invention, the electrolytic cell contains at least one cathode chamber and one anode plate, which are vertically arranged relative to each other. The advantage of this arrangement of electrolytic cell elements lies in the free removal of generated gases without their contact with the cathode chamber and feedstock elements placed in it. Contact of gases evolved at the anode with the cathode may interfere with the electrolytic reduction process, for example, in case of using graphite as a material of the anode plate, due to the formation of carbon when $CO_2$ or $CO_2$ ingredients get into the cathode chamber due to reduction according to chemical equations (3), (4), (5), followed by blocking the pores of feedstock elements with a dense layer of carbon and, thus, terminating the reduction process due to the termination of withdrawal of reaction products from the pores during both direct and indirect reduction and the termination of the supply of reduced active ingredient into the pores during indirect reduction. Moreover, such a process reduces current efficiency due to the consumption of electric current for contaminating reactions similar to the ones described in equations (3), (4), (5). In case other gases evolve, for example, $Cl_2$, their ingress into the cathode chamber can lead to destruction of the cathode chamber and/or the feedstock elements placed in it. In case of using an anode plate made of a material that is not consumed in the process of electrochemical reduction (the so-called inert anode), for example, made of $CaTiO_3$ or $CaRuO_3$, oxygen will be released at the anode plate; contact of oxygen with the cathode chamber and feedstock elements, can lead to oxidation and a significant reduction in the service life of the cathode chamber, as well as to oxidation of feedstock elements and, as a result, to a significant increase in the consumption of electric current for reduction and reduction time, leading to a decline in current efficiency of reduction process.

The proposed design of the vertical arrangement of the elements in the electrolytic cell allows avoiding these problems, ensuring the absence of any contact of gases released at the anode with the cathode chamber and the feedstock elements placed in it.

In the present invention, as opposed to the known solutions, an ordered arrangement of feedstock elements, made from feedstock, for reduction to the final metal is proposed. This arrangement of elements makes it possible to install feedstock elements in a controlled manner in order to increase the contact area of feedstock elements with the cathode chamber to achieve improved efficiency of electron transfer from the cathode chamber to feedstock elements in direct reduction. The ordered arrangement of feedstock elements also enables uniform flow path of the melt through them during the reduction process, which ensures carrier transfer, and also provides improved dissolution of the reduction reaction products formed on feedstock elements surface (for example, CaO when using CaO as the active ingredient), both in direct and indirect reduction. This arrangement of feedstock elements provides better quality and higher speed of the reduction process to produce the final metal, and also allows for a more controlled current process.

The reciprocating movements of the electrolytic cell during the reduction process provide an improved melt flow through the pores of feedstock elements and removal of reduction reaction products from stagnation zones of the melt, both in direct and indirect reduction, as well as the supply of fresh portions of the reduced active ingredient during indirect reduction.

To increase current efficiency of the reduction process, the embodiments of the present invention use an intermediate chamber. Its use has the following advantages:

owing to absorption by feedstock elements placed in the intermediate chamber, the number of ions and/or molecules of the reduced active ingredient (for example, $Ca^+$ ions and/or dissolved calcium metal $Ca^0$ molecules when using CaO as an active ingredient), which reach the anode, is reduced, thereby reducing contamination reactions leading to a decrease in current efficiency: otherwise, ions and/or molecules of the active ingredient (for example, $Ca^+$ ions and/or dissolved calcium metal $Ca^0$ molecules, when using CaO as an active ingredient) reach the anode and there they donate electrons (discharge), as it is described in chemical reactions (1), (2), thereby providing 'wasted' current consumption that does not lead to the reduction of feedstock elements;

the intermediate chamber reduces the electronic conductivity of the melt by weakening the concentration of the active ingredient (for example, $Ca^+$ ions and/or dissolved metallic calcium $Ca^0$ molecules when using CaO as an active ingredient), dissolved in the melt in the zone between the intermediate chamber and the anode, which reduces 'wasted' consumption of electric current, that does not lead to the reduction of feedstock elements.

After passing through at least one electrolytic reduction cycle, an intermediate chamber with feedstock elements can be used as a cathode chamber for a new electrolytic reduction cycle; current consumption for the reduction of these feedstock elements from the intermediate chamber is lower than for the reduction of freshly prepared feedstock elements.

The use of at least one current source, independently connected to the cathode chamber and one or two anode plates, makes it possible to control and monitor the progress of reduction process in each separate group (a group means a cathode chamber and an adjacent anode plate, or a cathode chamber and two adjacent anode plates) and, if necessary, adjust the voltage or amperage for each such group of the cell separately, which positively affects the quality of reduction of each feedstock element to the final metal.

The use of an additional electrolytic cell to reduce the concentration of an active ingredient in the melt. Moreover, after performing its function of reducing the concentration of an active ingredient in the melt, the additional electrolytic cell is then used as the main electrolytic cell to produce the final metal, which allows for the cut down of overall expenses for the process of electrolytic reduction of feedstock elements to the final metal.

BRIEF DESCRIPTION OF DRAWINGS

The invention will now be described with reference to the examples and drawings in which.

Figure 1:
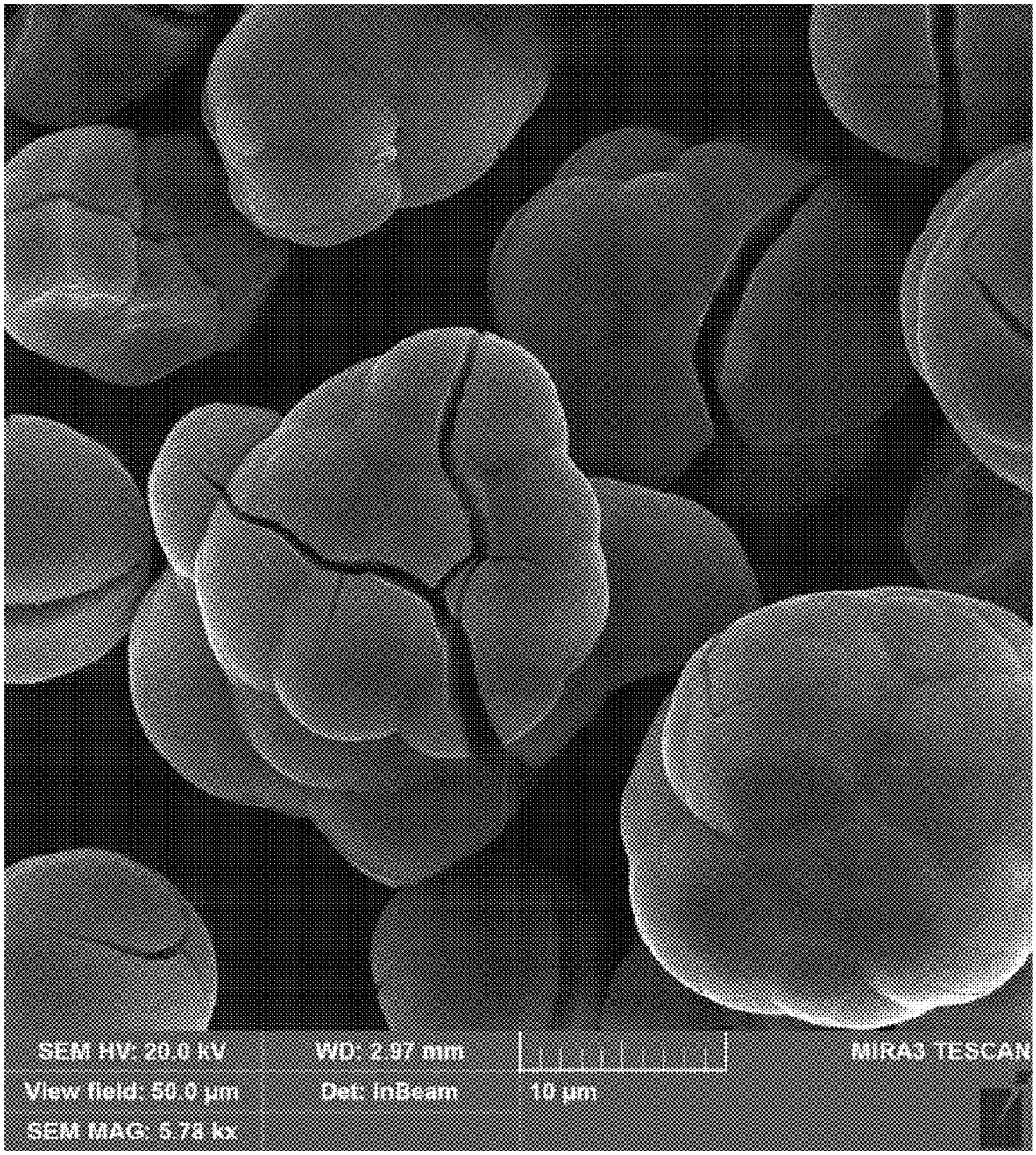
FIG. 1 illustrates the feedstock particles (magnification: 5,780×)

It should be taken into account that these figures are not necessarily drawn to scale.

DETAILED DESCRIPTION OF THE ILLUSTRATIVE EMBODIMENT

A preferred embodiment of a method for electrolytic reduction of feedstock elements, made from feedstock, according to the present invention will now be described with reference to schematic drawings of an apparatus for electrolytic reduction as proposed in the present invention.

To reduce the feedstock elements 10 and obtain the final metal with low content of oxygen and other impurities, suitable for processing into products (casting into ingots, producing powder for powder metallurgy, 3D printing, etc., manufacturing other products), the present invention uses feedstock with a metal oxide content of 97.0-99.9 wt. %, advantageously 98.0-99.9 wt. %, optimally 99.5-99.9 wt. %. The particle sizes of the feedstock used to form the feedstock elements for reduction fall within the range of 0.1-100.0 μm, advantageously 10.0-90.0 μm, further preferably 15.0-60.0 μm.

FIG. 1 shows, as one of the examples, a photographic image obtained using a scanning electron microscope Tescan Mira3, which offers the possibility to estimate the particle size of titanium dioxide feedstock that can be used to form feedstock elements.

Figure 2:
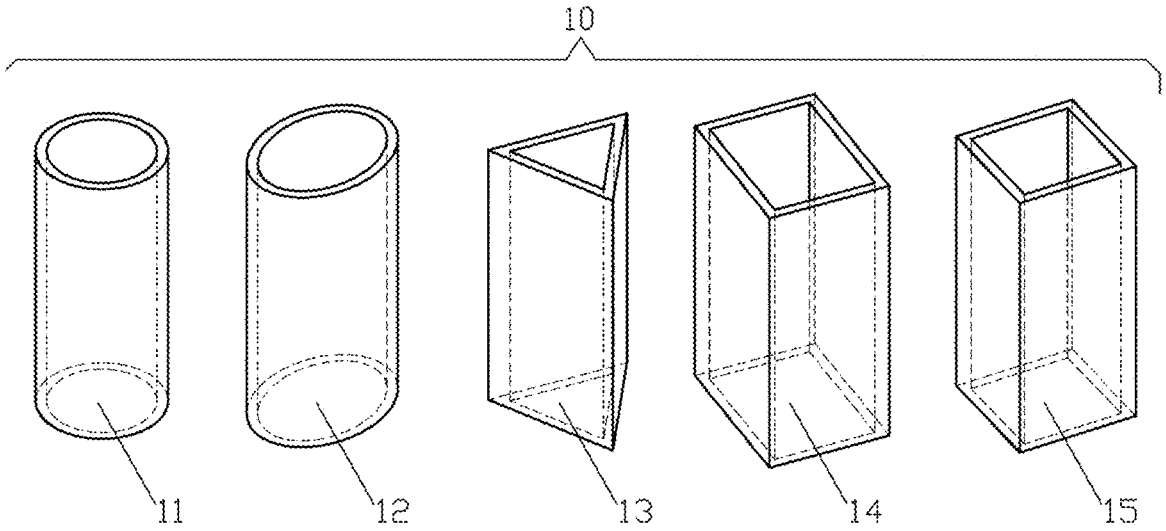
FIG. 2 illustrates the examples of feedstock elements.

FIG. 2 shows examples of shapes of the feedstock elements 10 subject to reduction according to the present invention. The feedstock elements 10 can be shaped as hollow cylinders 11 with a circular cross section; or hollow cylinders 12 with an oval-shaped cross section; or tubes 13 with a triangular cross section; or tubes 14 with a rectangular cross section; or tubes 15 with a square cross section.

The length of the feedstock elements 10 can be 1-100 mm, advantageously 10-90 mm, preferably 25-50 mm; the feedstock elements 10 have a hollow interior space so that they can be installed on suspension rods (mounting seats) of the cathode chamber to ensure free flow path of the melt, which contributes to the efficiency of the reduction process. Wall thickness of the feedstock elements 10 can be 1-25 mm, advantageously 2-15 mm, optimally 3-8 mm. In case of using feedstock elements with a 1-8 mm wall thickness, the porosity of the walls of such elements should be 20-70 vol. %, advantageously 40-70 vol. %, optimally 55-65 vol. %. In case of using elements with a 9-25 mm wall thickness, the porosity of the walls of such elements should be 55-85 vol. %, advantageously 60-80 vol. %, optimally 65-75 vol. %.

Figure 3:
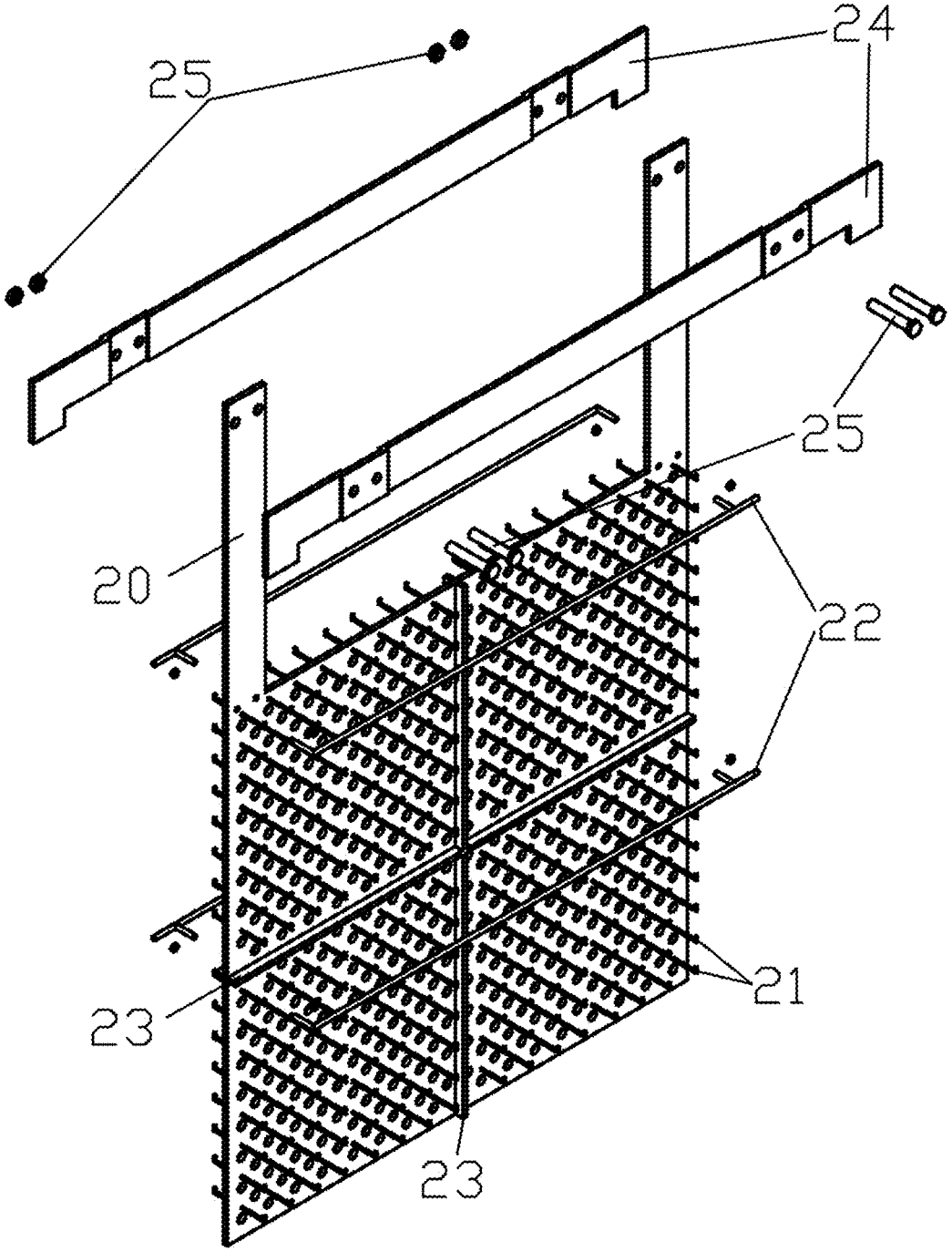
FIG. 3 is a general view of the cathode chamber.
Figure 4:
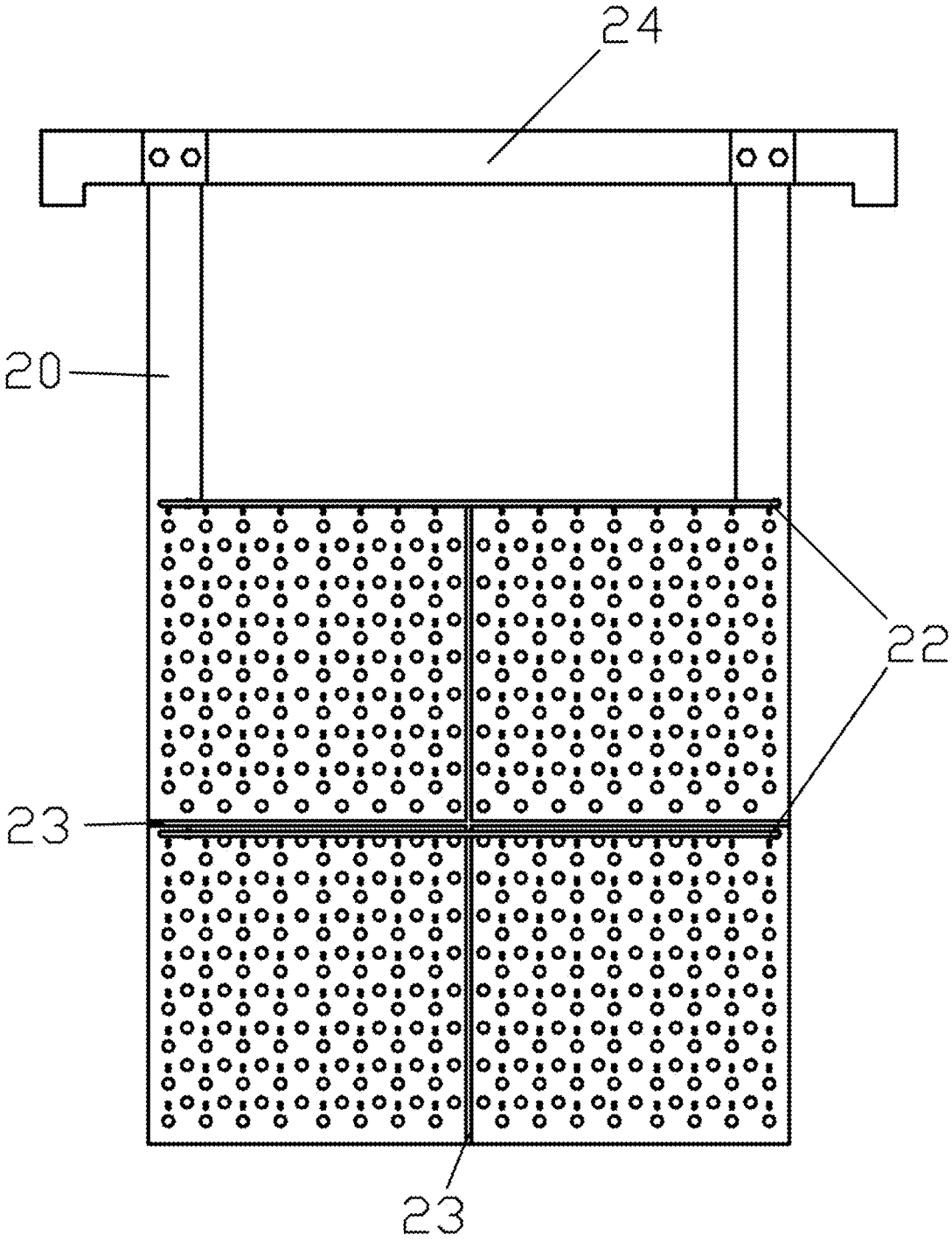
FIG. 4 is a front-view of the cathode chamber.

According to FIG. 3 and FIG. 4, the cathode chamber 20 is an open type plate, which is positioned vertically. The cathode chamber 20 comprises two vertical surfaces on which a plurality of suspension rods 21 is mounted. The suspension rods 21 are designed for an ordered arrangement of the feedstock elements 10 during the reduction process and ensure easy installation of the feedstock elements on the cathode chamber 20. In addition, the suspension rods 21 of the cathode chamber 20 are located at an angle of 90° to the cathode chamber 20 surface. Each side of the cathode chamber 20 contains fixing brackets 22 which are used to retain and hold the feedstock elements 10 undergoing reduction.

In a preferred embodiment, the cathode chamber 10 is made with stiffeners 23.

The cathode chamber 20 is fixed and held in the melt by means of metal strips 24 secured by bolted connections 25. The materials suitable for making the strips 24 include, but are not limited to AISI 310, nickel 200/nickel 201 or their equivalents. The strips 24 at the same time serve as conductors for transmitting electric current to the cathode chamber. The suspension rods 21 also provide a constant current supply to each of the orderly arranged feedstock elements 10 during the reduction process.

Figure 5:
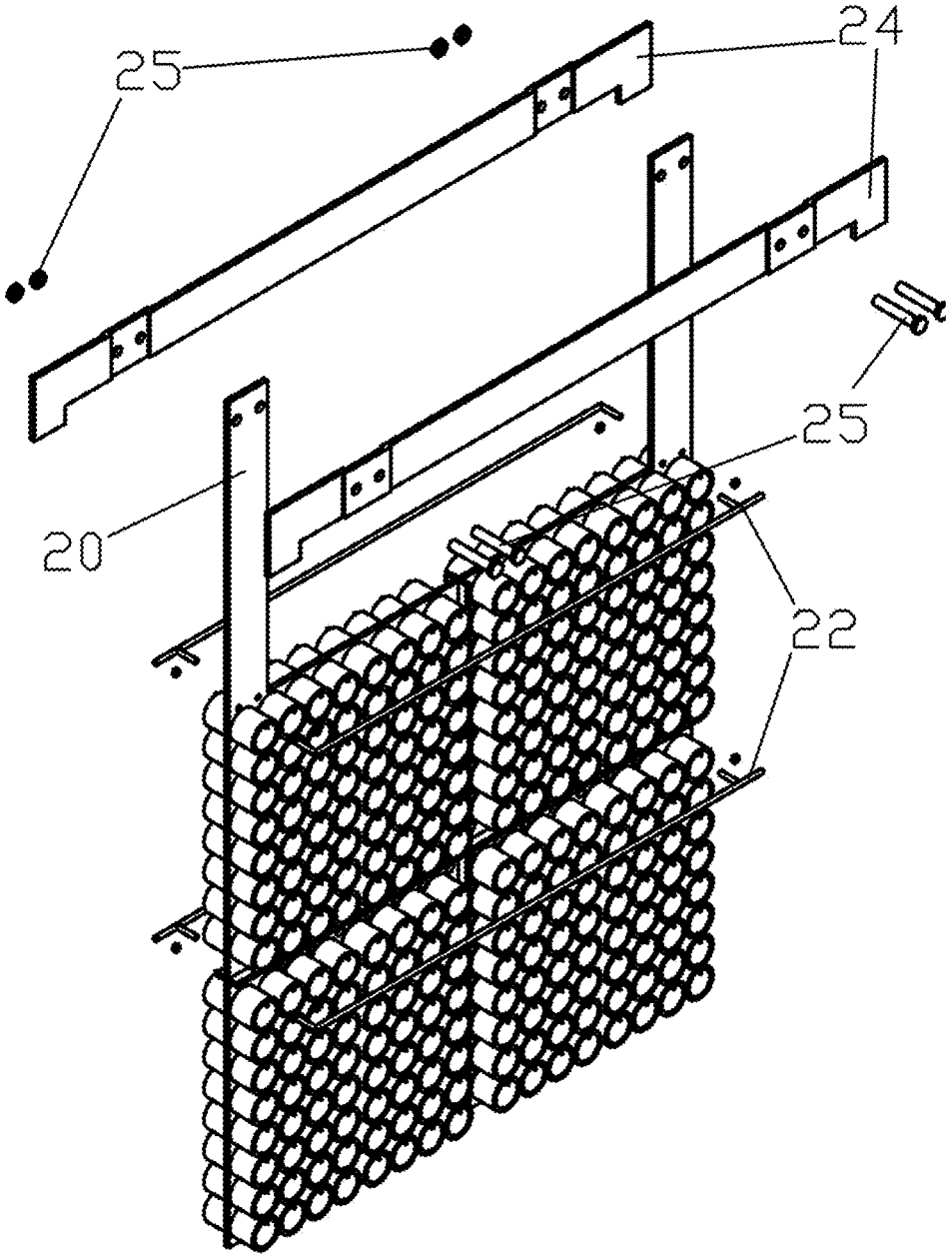
FIG. 5 is a general view of the cathode chamber with feedstock elements installed in it.
Figure 6:
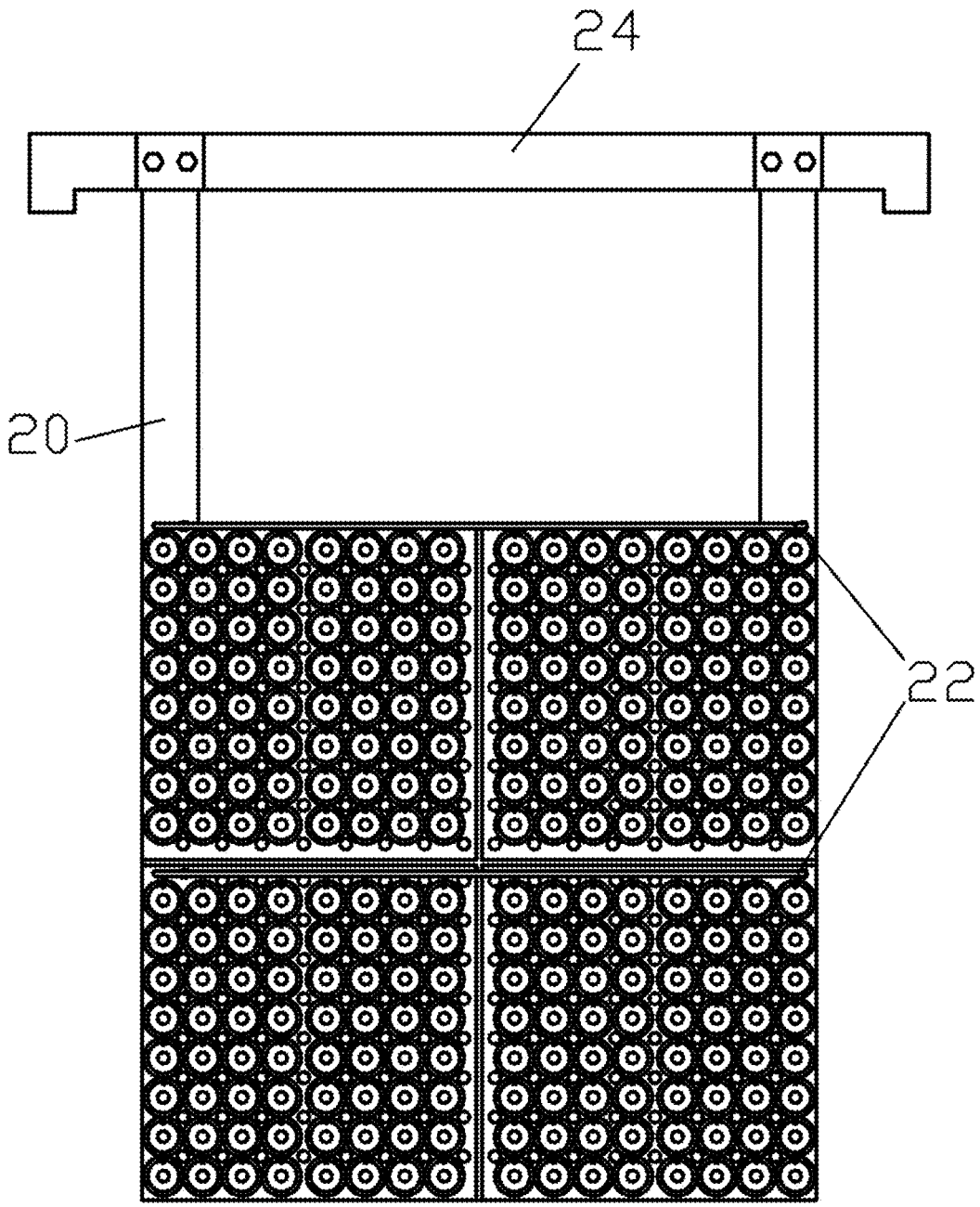
FIG. 6 is a front-view of the cathode chamber with feedstock elements installed in it.

FIG. 5 and FIG. 6 show an example of one cathode chamber 20 with the orderly arranged feedstock elements 10. The cathode chambers can be made of any suitable materials including, but not limited to, for example, AISI 310, nickel 200/nickel 201 or their equivalents.

Figure 7:
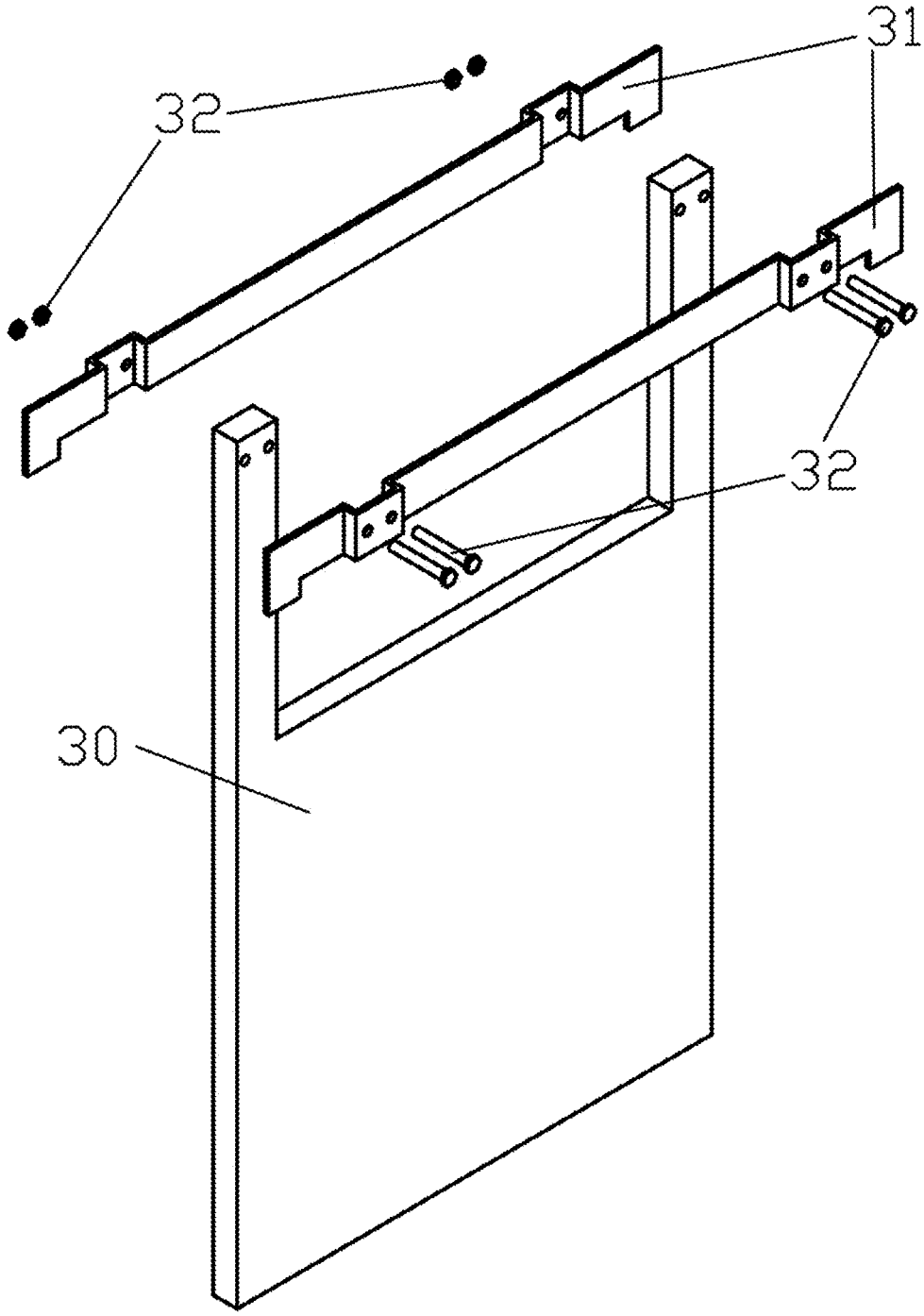
FIG. 7 is a general view of the anode plate.
Figure 8:
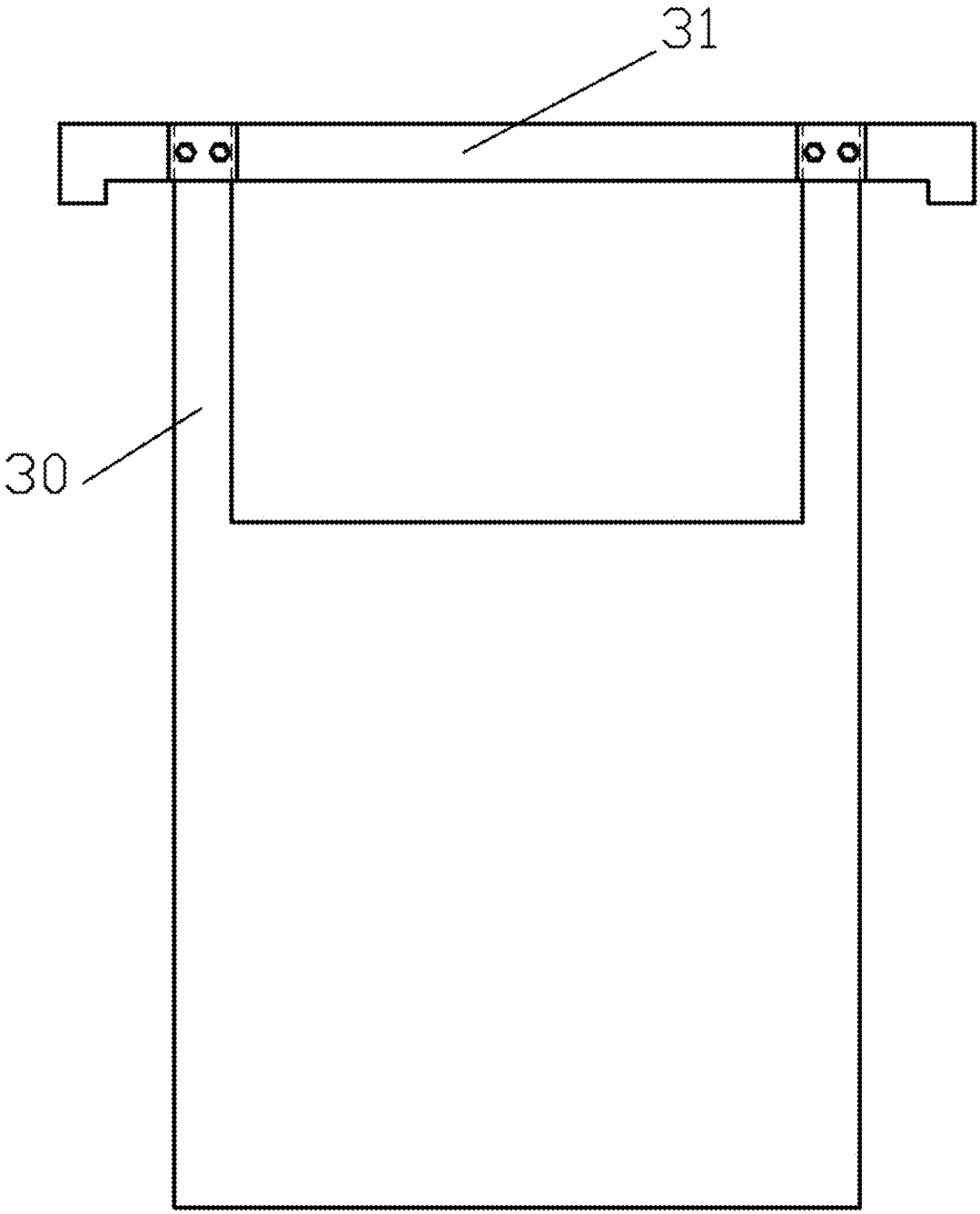
FIG. 8 is a front-view of the anode plate.

FIG. 7 and FIG. 8 show the anode plate 30. The anode plate 30 is fixed and held vertically in the melt by means of metal strips 31 secured by bolted connections 32. The materials suitable for making the strips 31 include, but are not limited to AISI 310, nickel 200/nickel 201 or their equivalents. The strips 31 at the same time serve as conductors for the drainage of electric current from the anode plate. The anode plate 30 can be made of, for example, but not limited to, high quality dense graphite with minimal porosity, $CaTiO_3$, $CaRuO_3$.

The cathode chamber 20 and the anode plate 30 are shown in a rectangular form in the drawings. However, these elements are not limited in shape and can be made having any suitable configuration.

Figure 9:
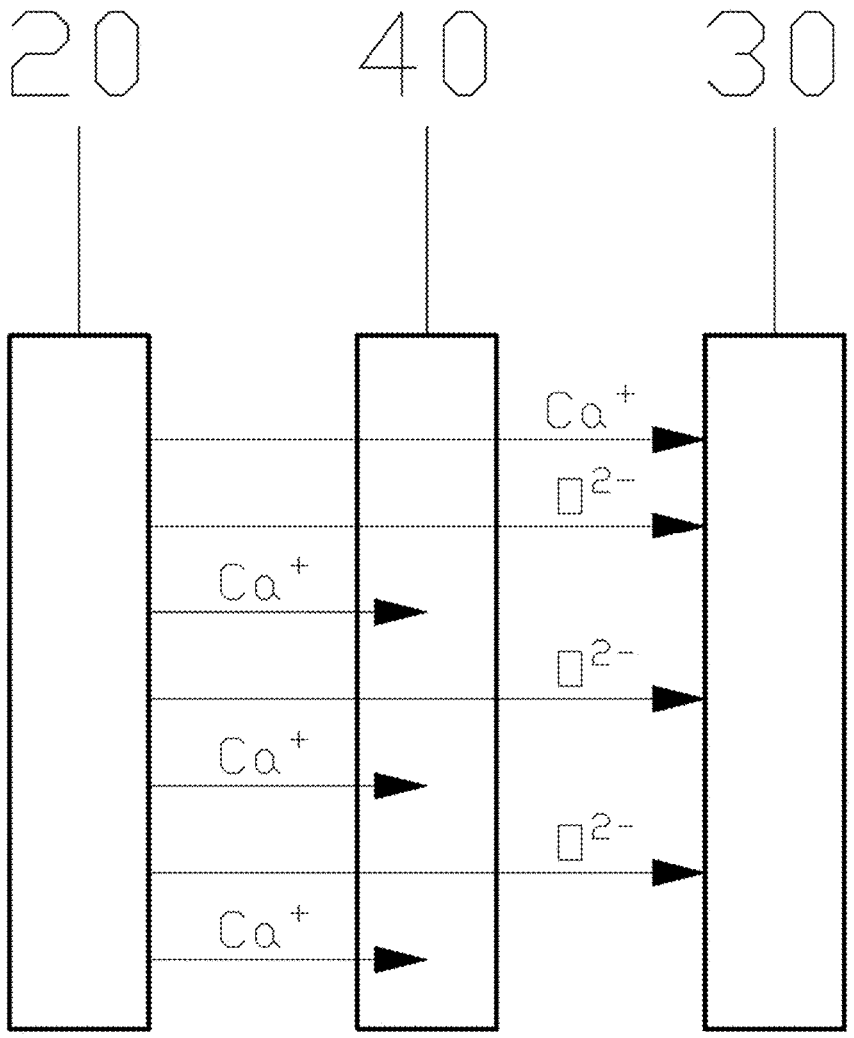
FIG. 9 is a schematic illustration showing the positions of the intermediate chamber, the cathode chamber and the anode plate.

In one of the embodiments, the present invention provides for the use of an intermediate chamber. FIG. 9 schematically shows the intermediate chamber 40. The intermediate chamber 40 is designed similar to the cathode chamber and is held in the melt by means of strips 24 secured by bolted connections 25. A plurality of suspension rods 21 are installed on the vertical surfaces of the intermediate chamber.

FIG. 9 shows the intermediate chamber 40 positioned between the cathode chamber 20 and the anode 30. According to its intended purpose, the intermediate chamber 40 functions as a quasi-membrane that absorbs and/or oxidizes the ions of the active ingredient metal, reduced during electrolysis, thereby reducing the number of reduced active ingredient ions which get on the anode, and also reducing the electronic conductivity of the melt.

According to the present invention, the design of the electrolytic cell is a set of vertically arranged cathode chambers and anode plates in the number required for the industrial production of metal, immersed in a rectangular or square bath.

Figure 10:
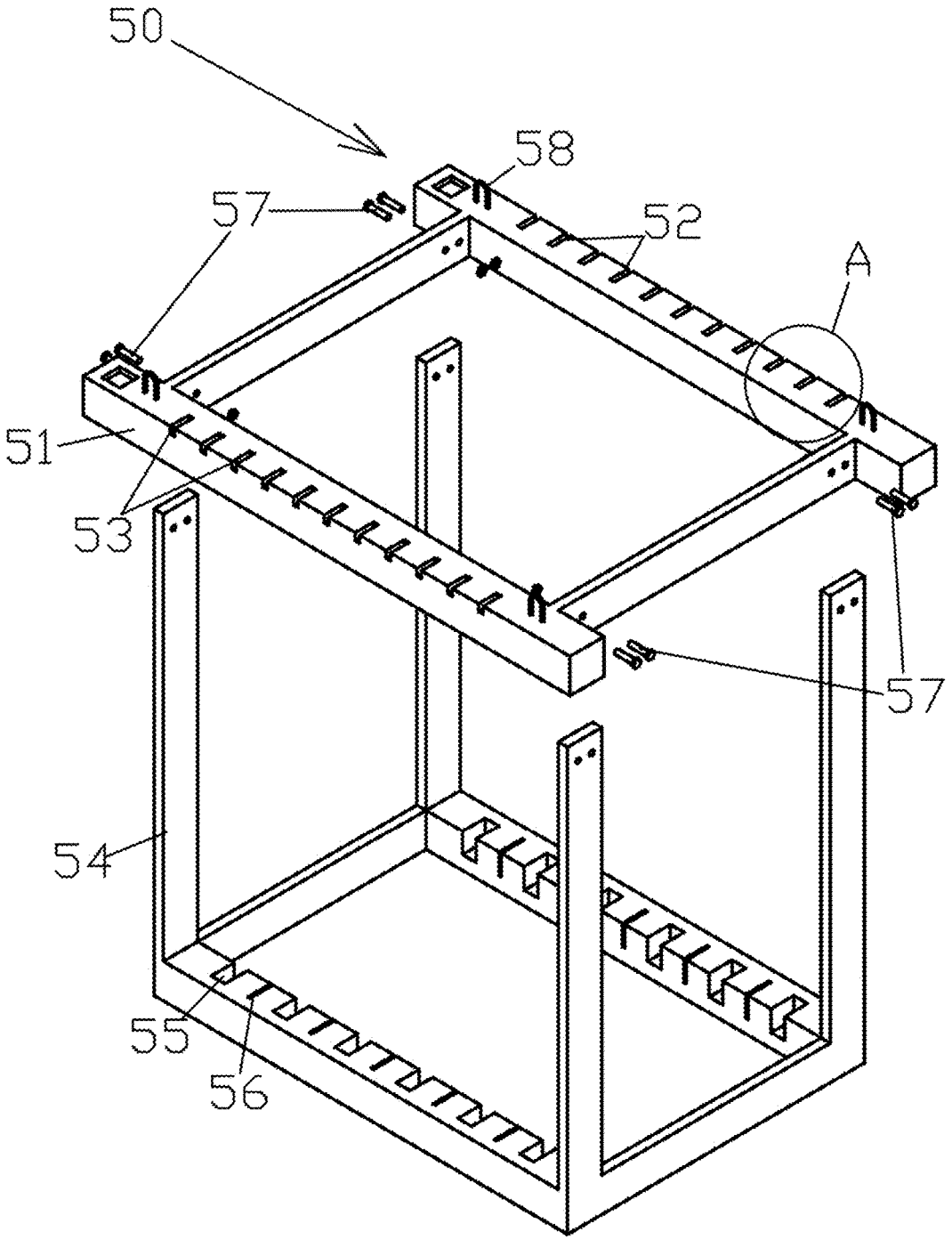
FIG. 10 is a general view of the supporting frame.
Figure 11:
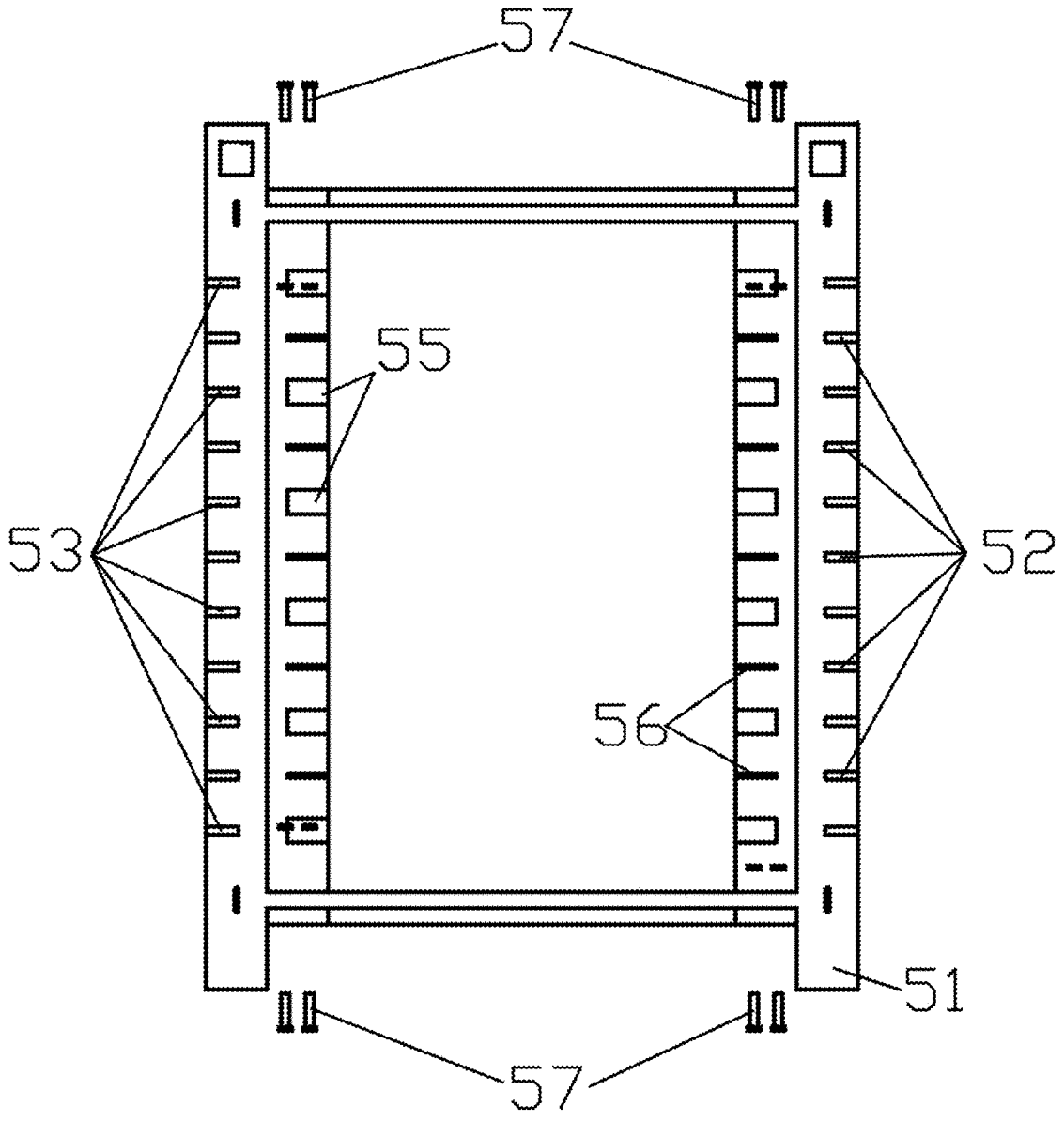
FIG. 11 is a plan-view of the supporting frame.

As shown in FIG. 10 and FIG. 11, the supporting frame of the electrolytic cell 50 consists of an upper part 51, in which special slots 52 are made for mounting and fixing the cathode cell 20 and slots 53 for mounting and fixing the anodes 30. The design of the electrolytic cell 50 provides that the upper part 51 of the supporting frame also ensures current supply to the anodes 30 and cathodes 20 (to each of them separately) by means of a contact terminal relay for connecting buses.

The lower part 54 of the supporting frame of the electrolytic cell 50 is electrically isolated from the upper part 51 of the frame and is designed to hold and fix the anodes 30 and cathodes 20 by installing the lower parts of the anodes and cathodes into special fixing slots: the slot 55 for the anode 30 and the slot 56 for the cathode 20. The lower part 54 is attached to the upper part 51 by means of the fixing bolt connection 57. The supporting frame is moved by means of mounting loops 58.

Figure 12:
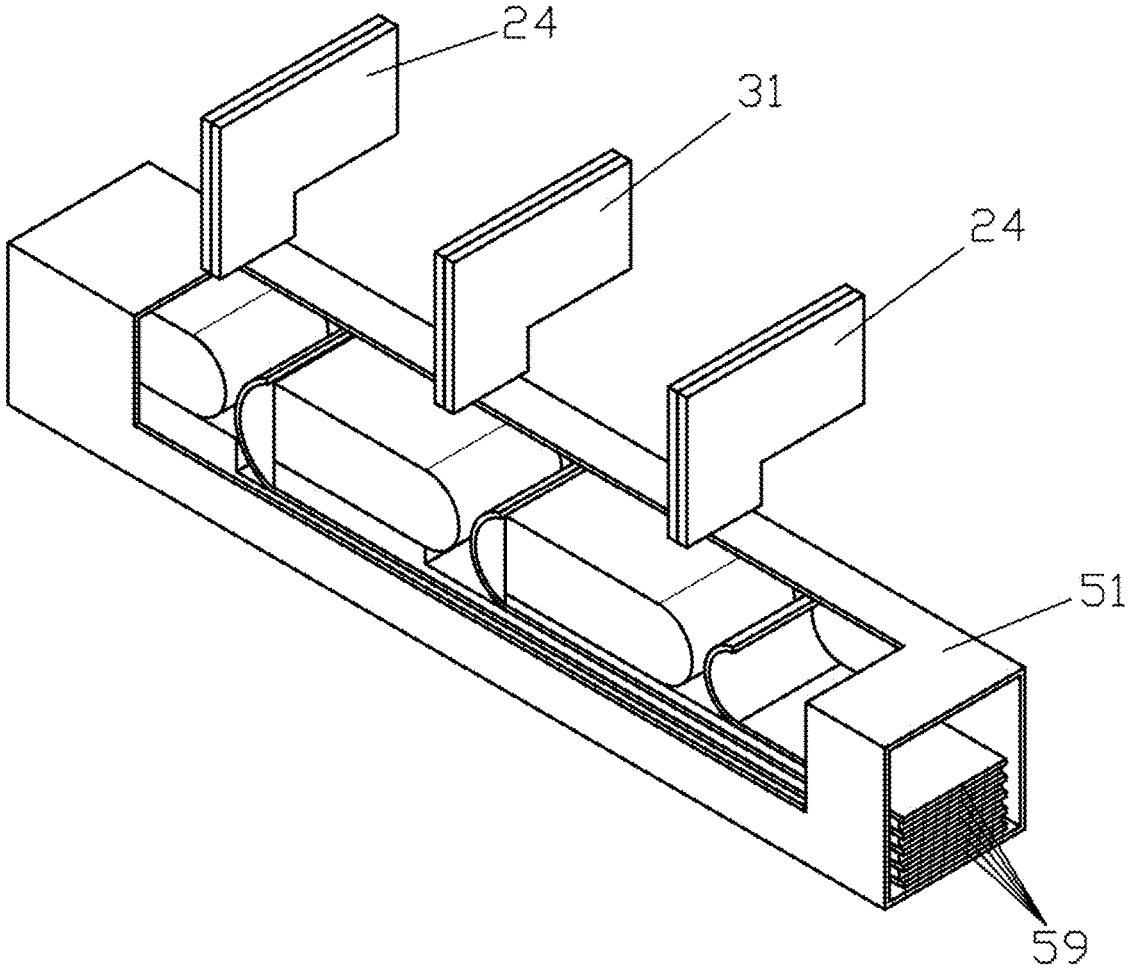
FIG. 12 is a cutaway view of the upper frame 51 according to A in FIG. 10.

FIG. 12 shows a cutaway view of the frame 51. The terminals 59 are positioned in the slots 52 and 53. The terminals 59 are isolated from each other and can be of a cam type, or any other type. This design ensures that the current is supplied separately:

- to each pair of elements—to one cathode chamber 20 and to one anode plate 30; or
- to each pair of elements or to one cathode chamber 20 and to two anode plates 30 adjacent to the cathode.

Figure 13:
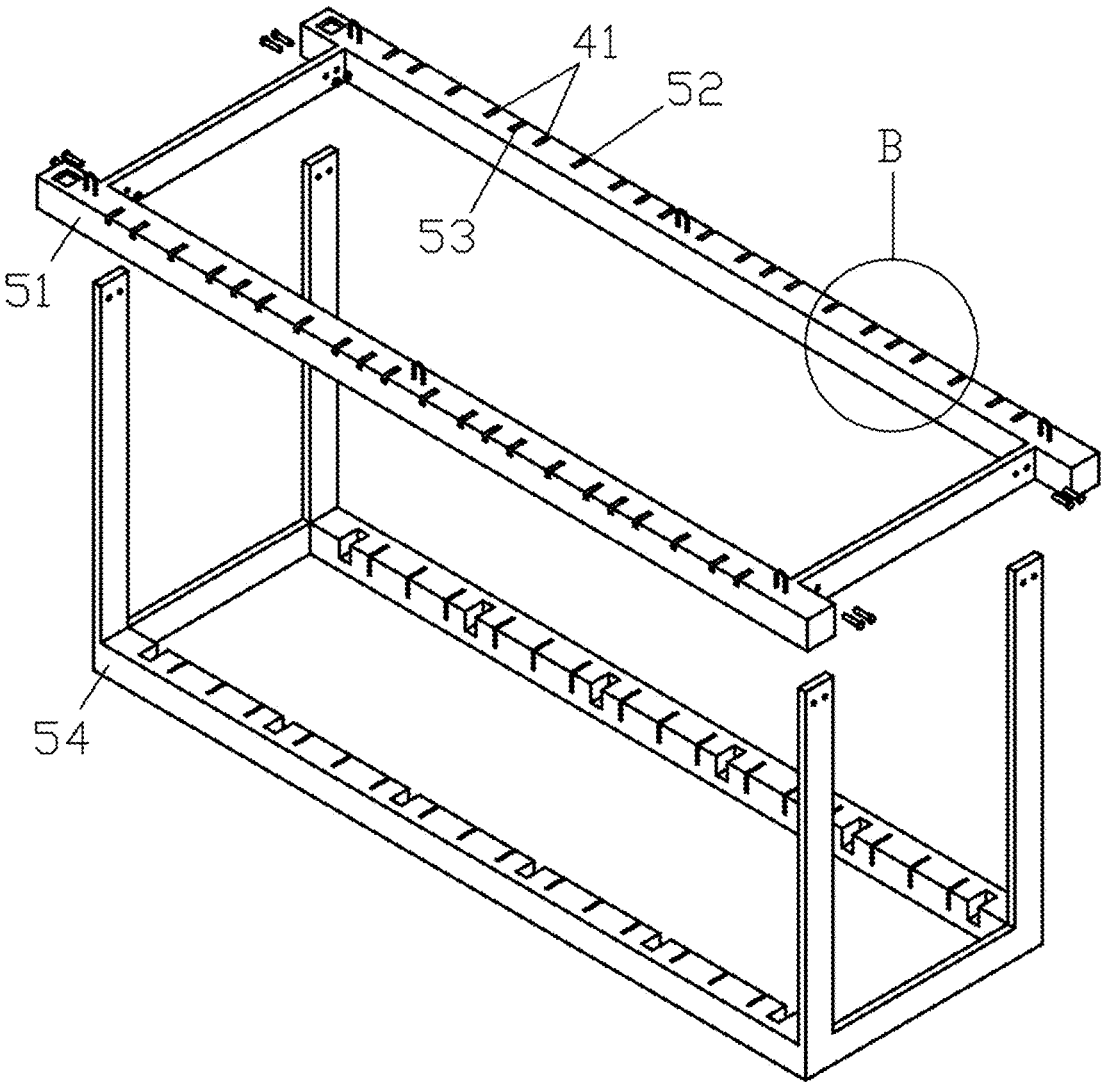
FIG. 13 shows the supporting frame for the apparatus according to claim 18 (general view)
Figure 14:
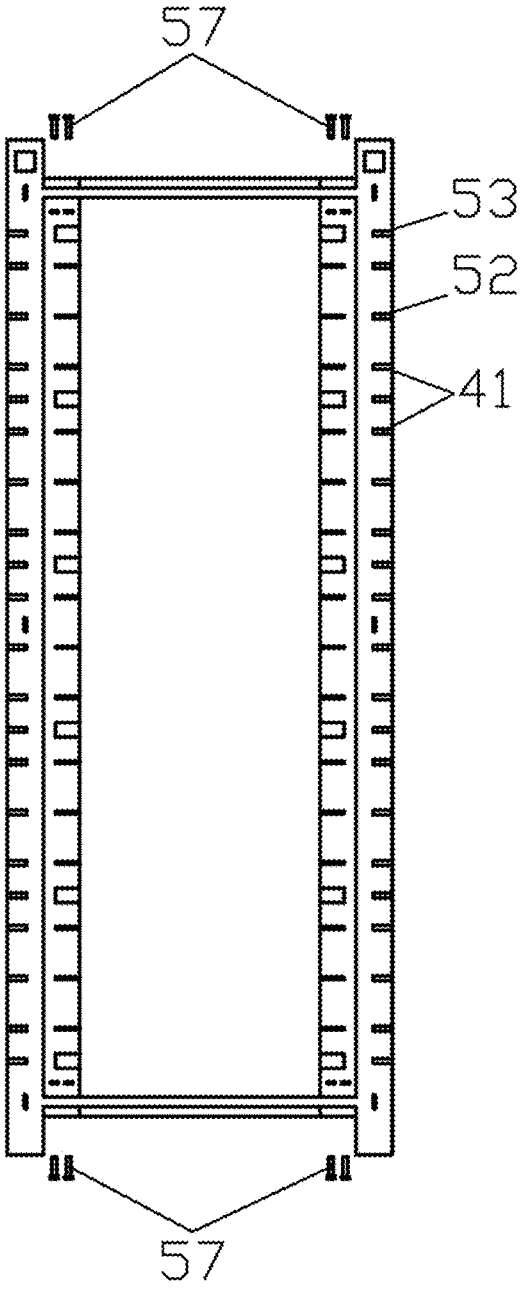
FIG. 14 shows the supporting frame for the apparatus according to claim 18 (plan view)

In one of the embodiments, the electrolytic cell is additionally provided with an intermediate chamber 40. For this intermediate chamber to be installed in the supporting frame, additional slots 41 are made in the upper 51 and lower parts 54 of the supporting frame, without supplying current to them; the slots are only needed for fixing the chamber (as shown in FIG. 13 and FIG. 14). The upper and lower parts of the supporting frame are made using any kinds of round, rectangular pipes; the material for these pipes can be selected from AISI 310, nickel 200/nickel 201, their equivalents, etc., and if necessary coated with a ceramic protective coating.

Figure 15:
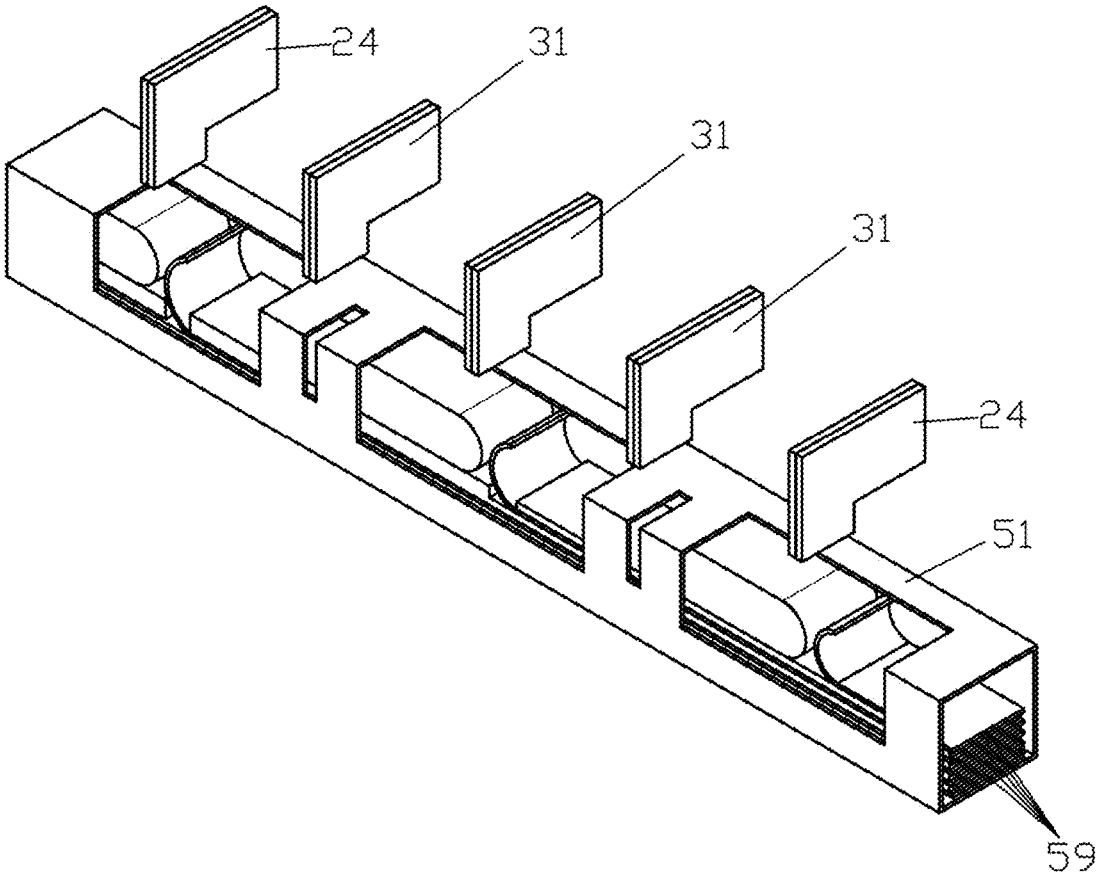
FIG. 15 is a cutaway view of the upper frame 51 according to B in FIG. 13.

FIG. 15 shows a cutaway view of the frame 51. Strips 24 are installed in slots 41. No electric current is supplied to the strips 24.

Figure 16:
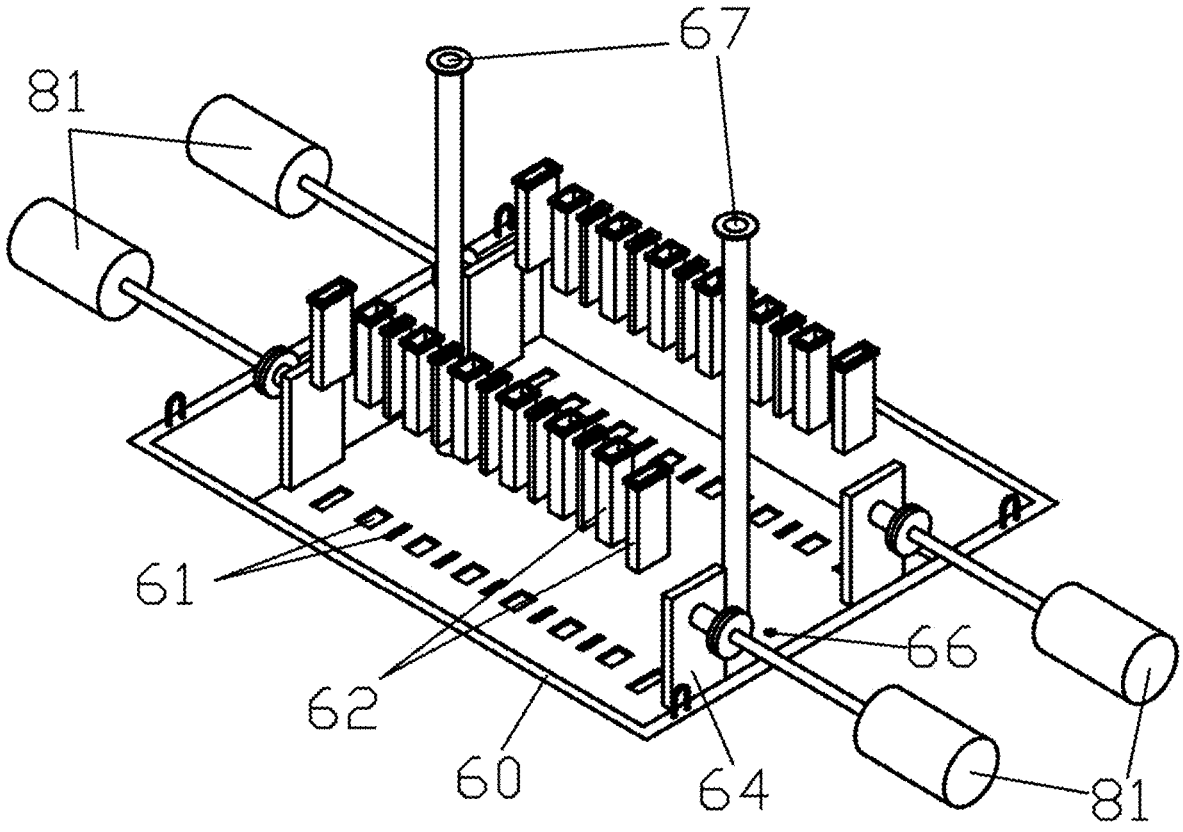
FIG. 16 is the electrolyzer bath insert plate (general view)
Figure 17:
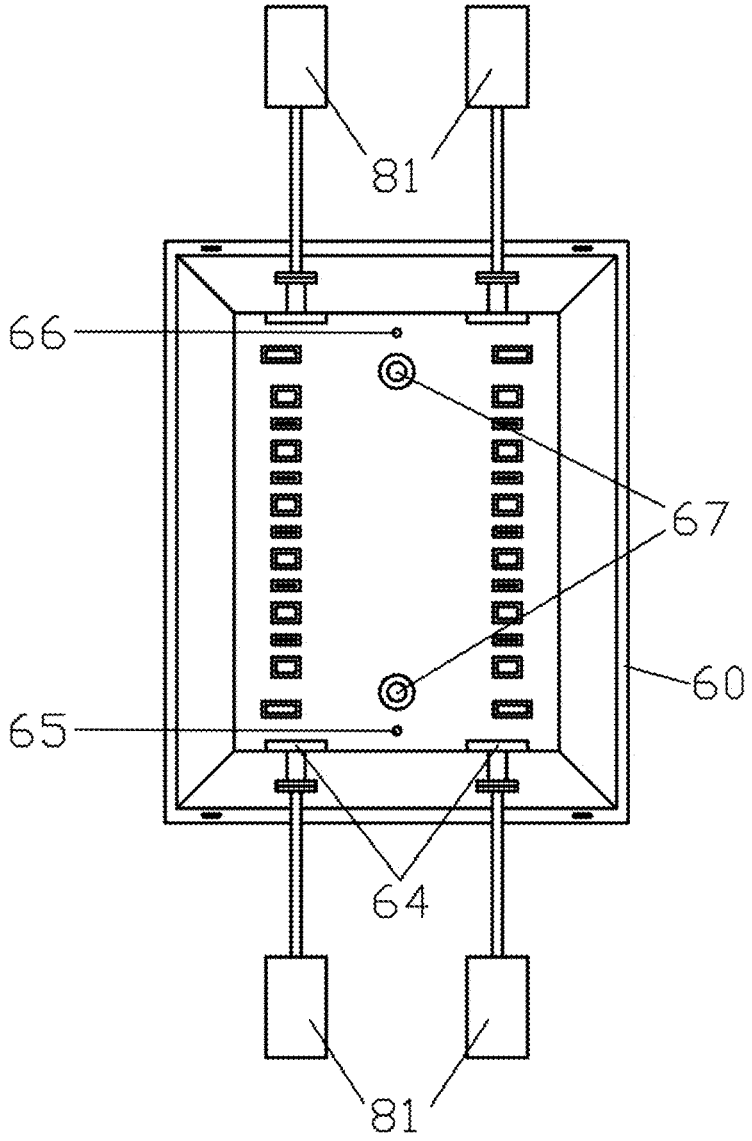
FIG. 17 is the electrolyzer bath insert plate (plan view)

FIG. 16 and FIG. 17 show the electrolyzer bath insert plate. The electrolyzer bath insert plate 60 is designed so that it is installed on the electrolyzer bath 70; the insert plate having larger surface area than the electrolyzer bath size to ensure tightness during horizontal movement (wobbling) of the entire electrolytic cell 50. The movement of the electrolytic cell 50 is carried out by means of pushers 81 installed outside the electrolyzer cover 80. The designs of the pushers may include any of the designs known from the prior art, and they can be driven using a pneumatic or electric drive. The space between the electrolyzer bath insert plate and the electrolyzer cover is filled with insulating material. Special holes 61 are made in the insert plate 60 for installing protective insulating cases 62 of the anodes and cathodes in the gas phase. Protective cases can be made of ceramics suitable for these purposes. The horizontal movement of the electrolytic cell 50 is carried out by the force of the pushers 81 applied to the support plates 64 which are pushed forward to a certain distance of 1-10 cm, advantageously 3-8 cm, optimally 5-7 cm. To adjust and control the temperature of the melt, in the electrolyzer bath insert plate 60 there are two holes 65 and 66 for the installation of thermocouples. To remove evolved gases for cleaning and refining, in the electrolyzer bath insert plate 60 there are two gas outlets 67.

Figure 18:
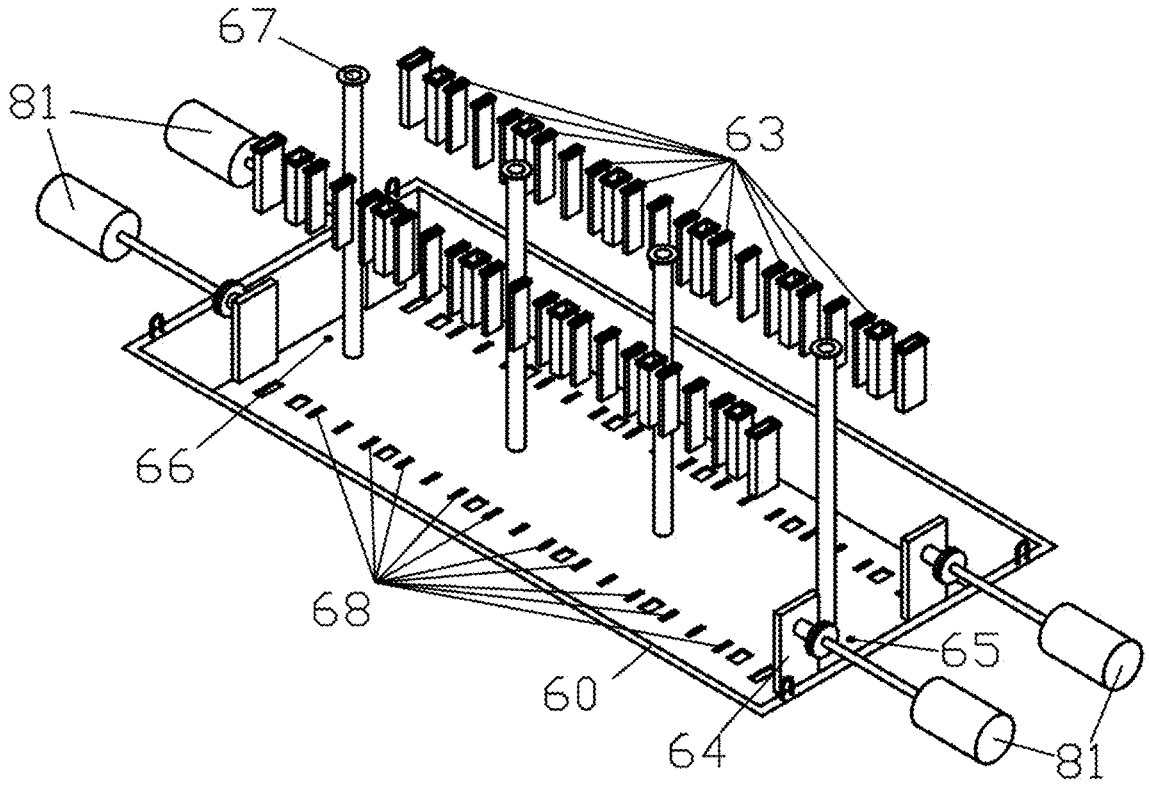
FIG. 18 shows the electrolyzer bath insert plate for the apparatus according to claim 18 (general view)
Figure 19:
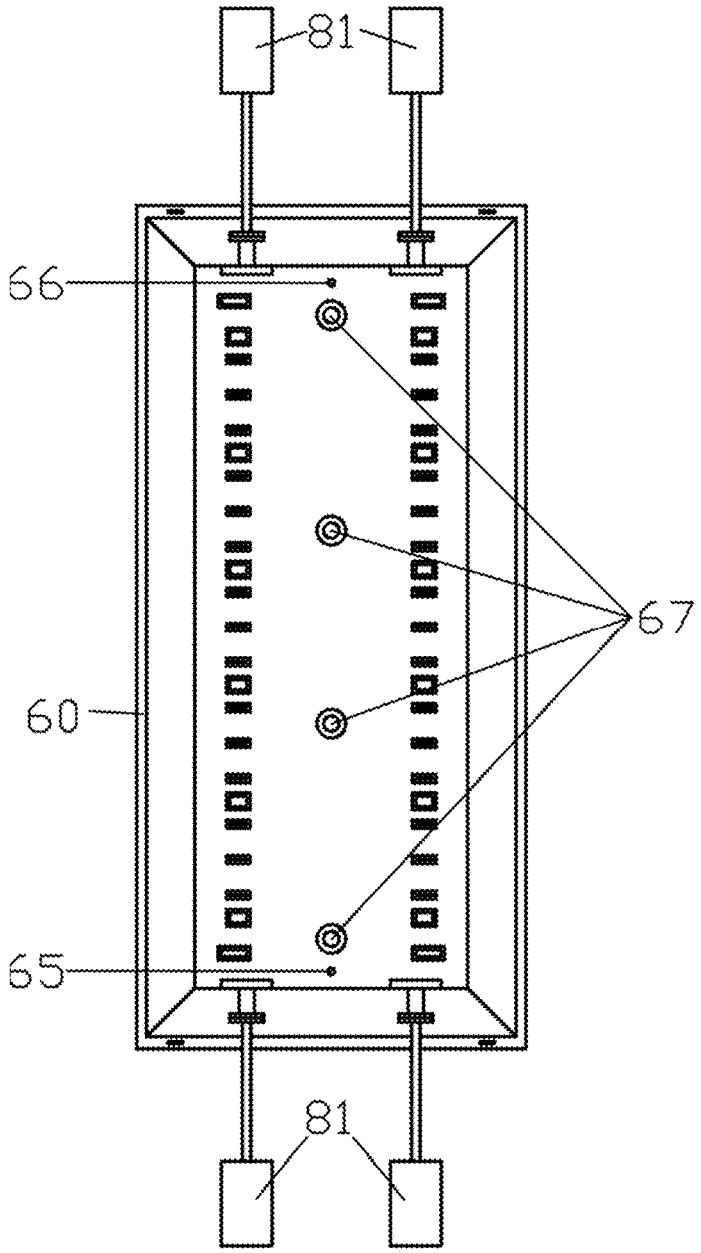
FIG. 19 shows the electrolyzer bath insert plate for the apparatus according to claim 18 (plan view)

In one of the embodiments, the electrolytic cell is additionally provided with an intermediate chamber 40. In case of using the intermediate chamber 40, additional holes 68 are made in the electrolyzer bath insert plate 60 and additional insulating ceramic cases 63 are installed (as shown in FIG. 18 and FIG. 19).

Figure 20:
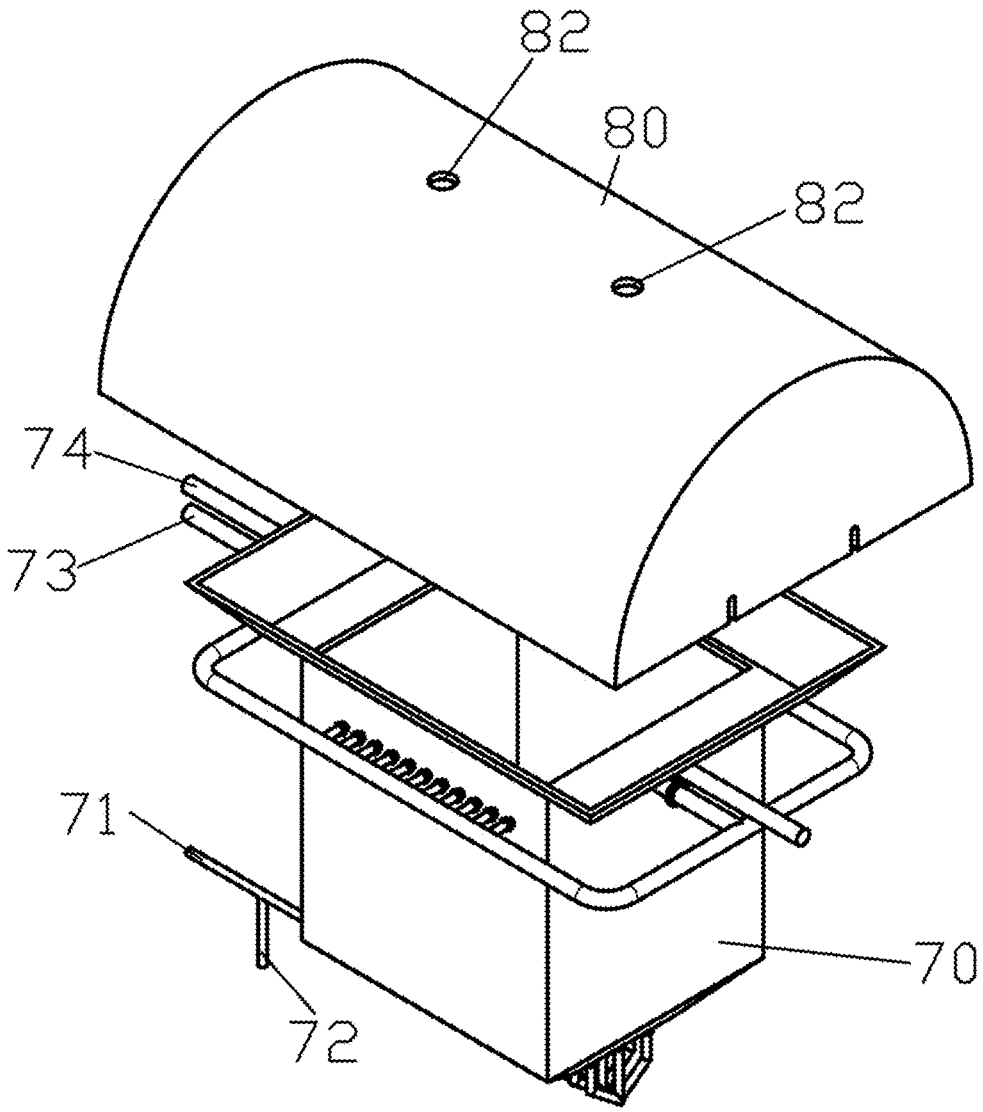
FIG. 20 is the electrolyzer bath (general view)
Figure 21:
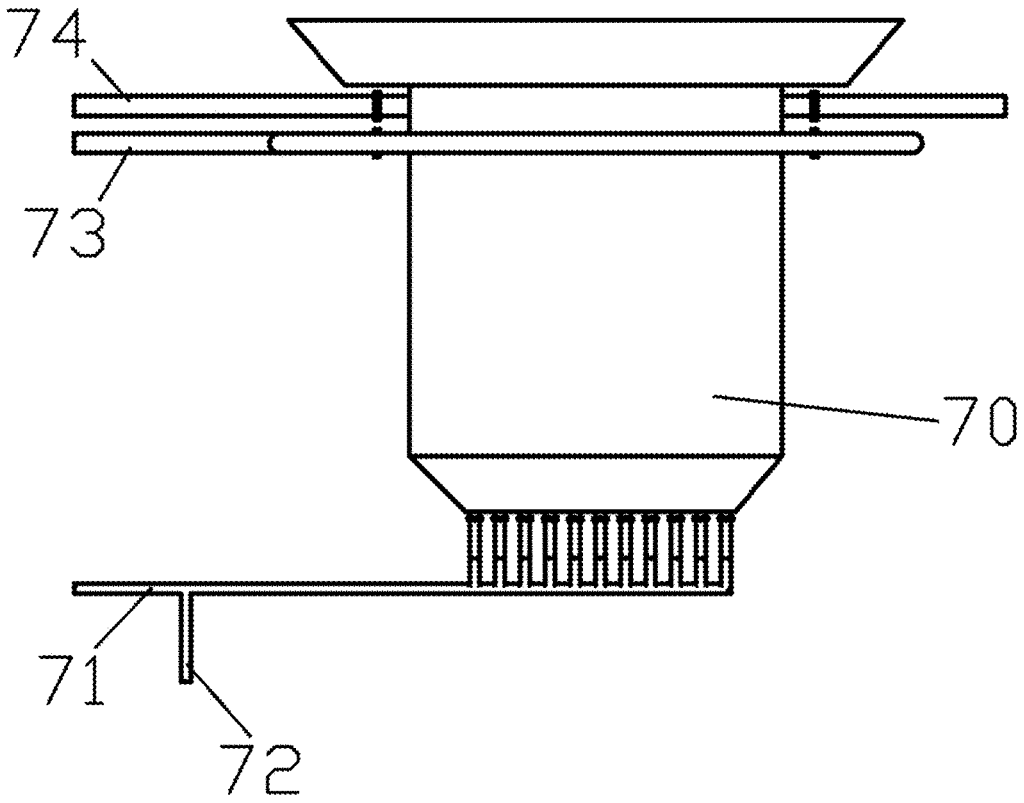
FIG. 21 is the electrolyzer bath (front view)

FIG. 20 and FIG. 21 illustrate the electrolyzer bath. In its lower part the electrolyzer bath 70 is connected to the pipelines 71 for supplying molten salt so that the salt enters the space between the cathode chamber 20 and the anode plates 30. In the lower part of the bath 70 there is also a pipeline 72 for supplying hot or cold argon into the melt supply line, depending on the need. In the upper part of the bath there are molten salt outlets 73 and hot or cold argon inlets 74. The bath can be made of steel AISI 310, nickel 200/nickel 201 or their equivalents, etc., as well as of high-strength graphite or ceramics. Cold argon is fed into the space of the electrolyzer, where the heating elements are located, using pipelines 75, from where it further flows through the pipe 74 into the upper part of the electrolyzer bath. In the upper part of the electrolyzer cover 80 there are outlets for the evolved gases 82.

Figure 22:
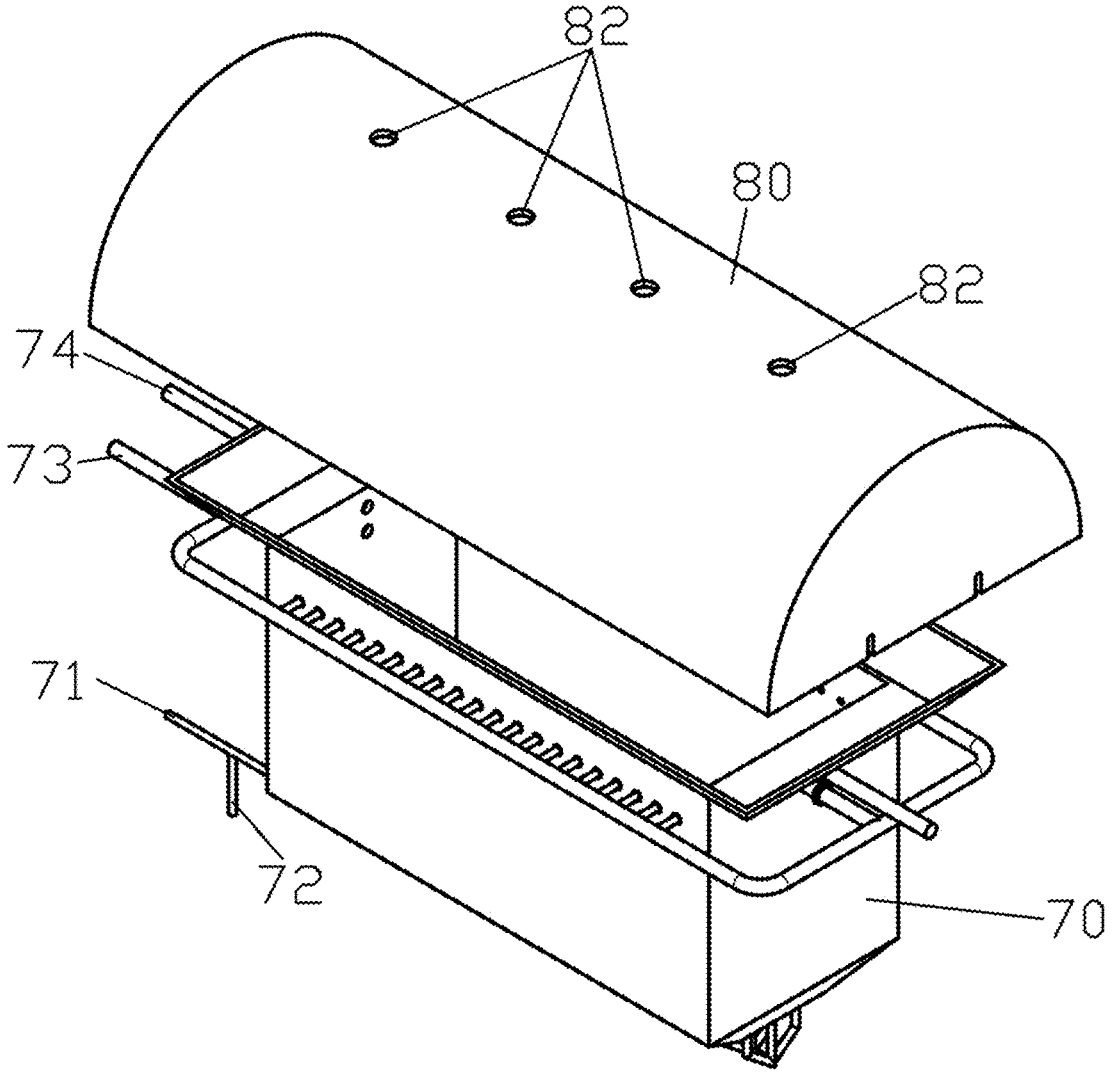
FIG. 22 shows the electrolyzer bath for the apparatus according to claim 18 (general view)
Figure 23:
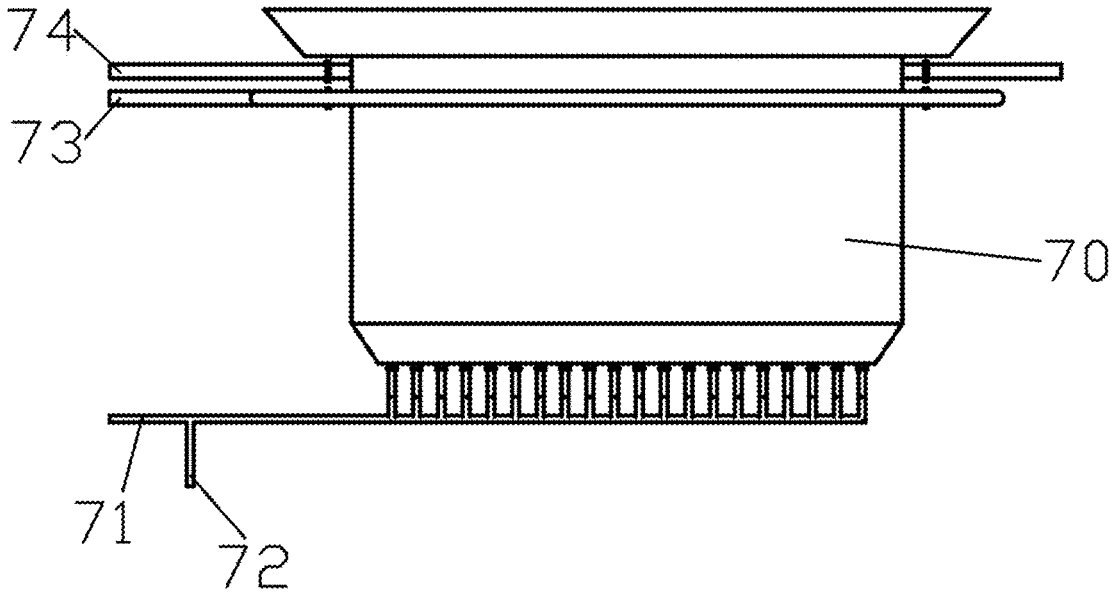
FIG. 23 shows the electrolyzer bath for the apparatus according to claim 18 (plan view)

In one of the embodiments, the electrolytic cell is additionally provided with an intermediate chamber 40. In case of using at least one intermediate chamber 40, the design of the bath 70 is similar to that shown in FIG. 22 and FIG. 23.

The electrolyzer bath is installed in the body of the furnace 83, equipped with heating elements 84 to maintain the optimum process temperature in the bath.

Figure 24:
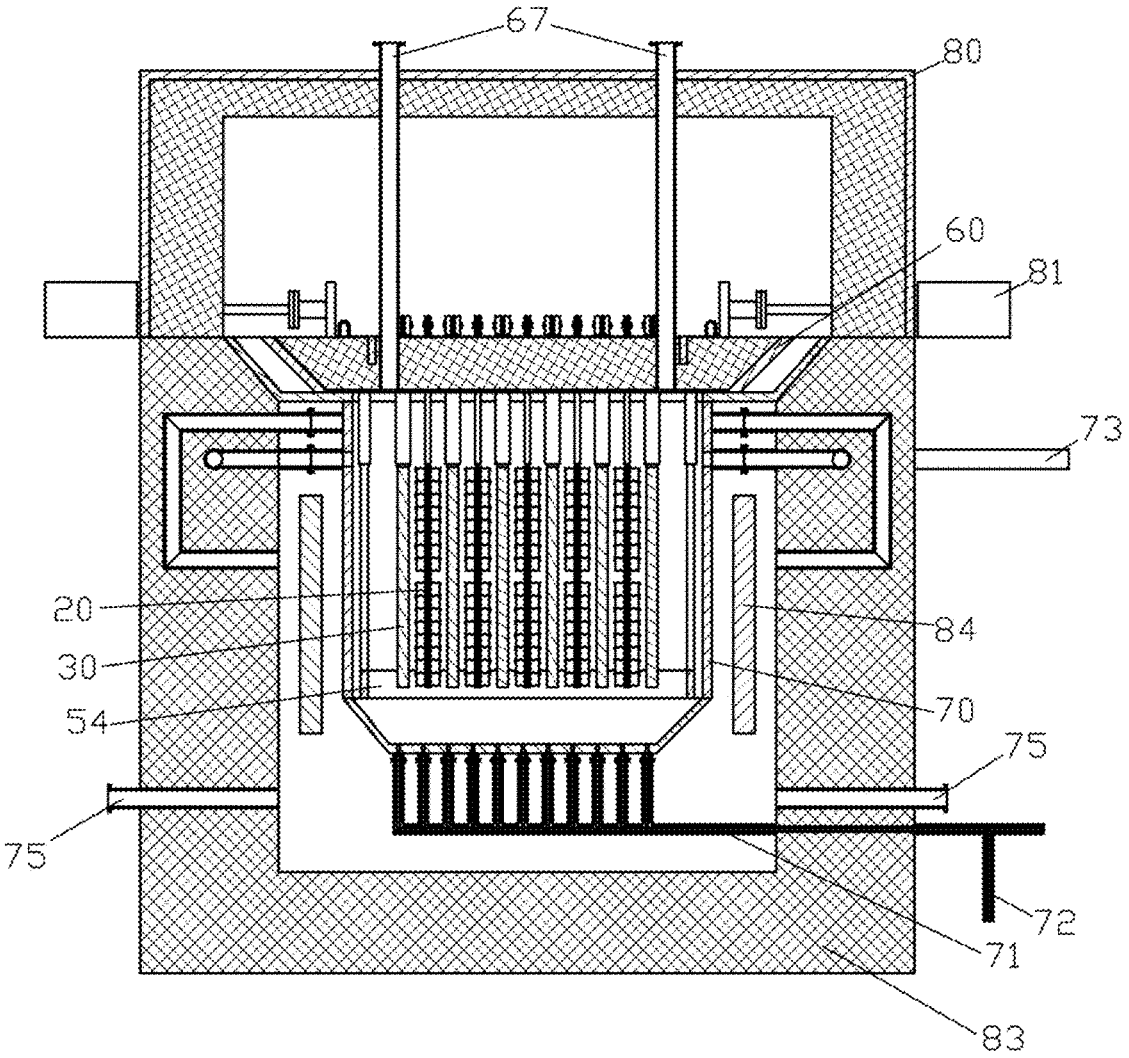
FIG. 24 schematically shows the proposed apparatus for the electrolytic reduction of feedstock elements (vertical section)
Figure 25:
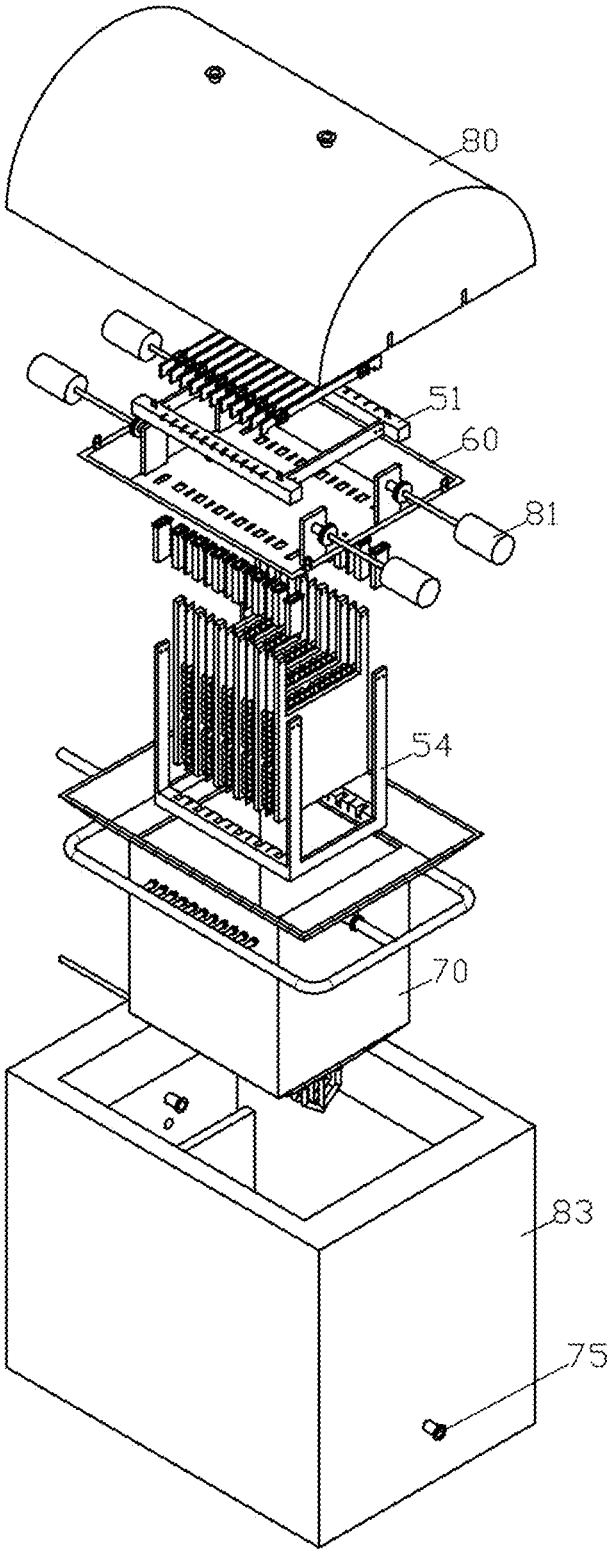
FIG. 25 shows the detailed elaboration of the proposed apparatus.

FIG. 24 and FIG. 25 schematically show the proposed apparatus for the electrolytic reduction of feedstock elements. The electrolytic cell contains at least one cathode chamber and two anode plates, which are vertically arranged relative to each other. More specifically, the design of the electrolytic cell is a set of vertically arranged cathode chambers and anode plates in the number required for the industrial production of metal, immersed in a rectangular or square bath. This arrangement of the cell allows for horizontal reciprocating movement of the entire cell at a speed of 0.1-3 cm/sec by means of a device for moving the said electrolytic cell; the device being the pushers 81, which can be either pneumatically or electrically driven. The frequency of horizontal movement of the electrolytic cell is 1-48 movements within 24 hours during the entire process of deoxidation, while the concentration of the active ingredient in the melt, for example, CaO, which should not exceed 6 mol. %, is carefully monitored.

The reciprocating movements of the entire cell during the reduction process provide improved melt flow through the pores of the feedstock elements and removal of reduction reaction products from stagnation zones of the melt, both in direct and indirect reduction, as well as supply of fresh portions of the reduced active ingredient during indirect reduction.

Each cathode chamber 20 on both sides is adjacent to the anode plate 30, which ensures the completeness of feedstock elements 10 reduction along their full length and allows to reduce the size of the zones that are deficient in electrons.

Moreover, the electrolytic cell is provided with at least one current source, each current source is independently connected to the cathode chamber and one or two anode plates. Such a connection makes it possible to control and manage the reduction process, for example, in each cathode chamber and anode plate, or in the three cell elements (two cathode chambers and an anode plate) separately and, if necessary, adjust the voltage or amperage for each such pair or triple of cell elements separately, which positively affects the completeness of reduction of each feedstock element to the final metal, as well as the ability to control and manage the reduction process in each individual cathode chamber.

Figure 26:
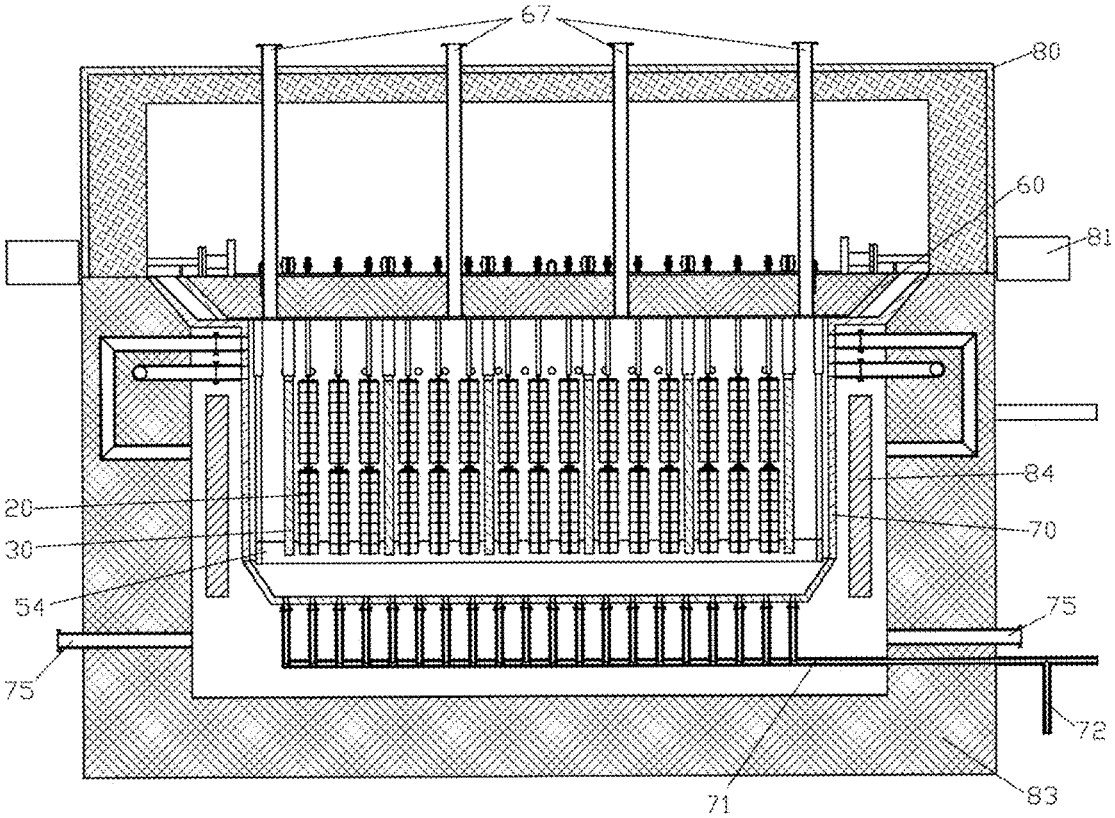
FIG. 26 schematically shows the proposed apparatus, in which the electrolytic cell is additionally provided with an intermediate chamber (vertical section)
Figure 27:
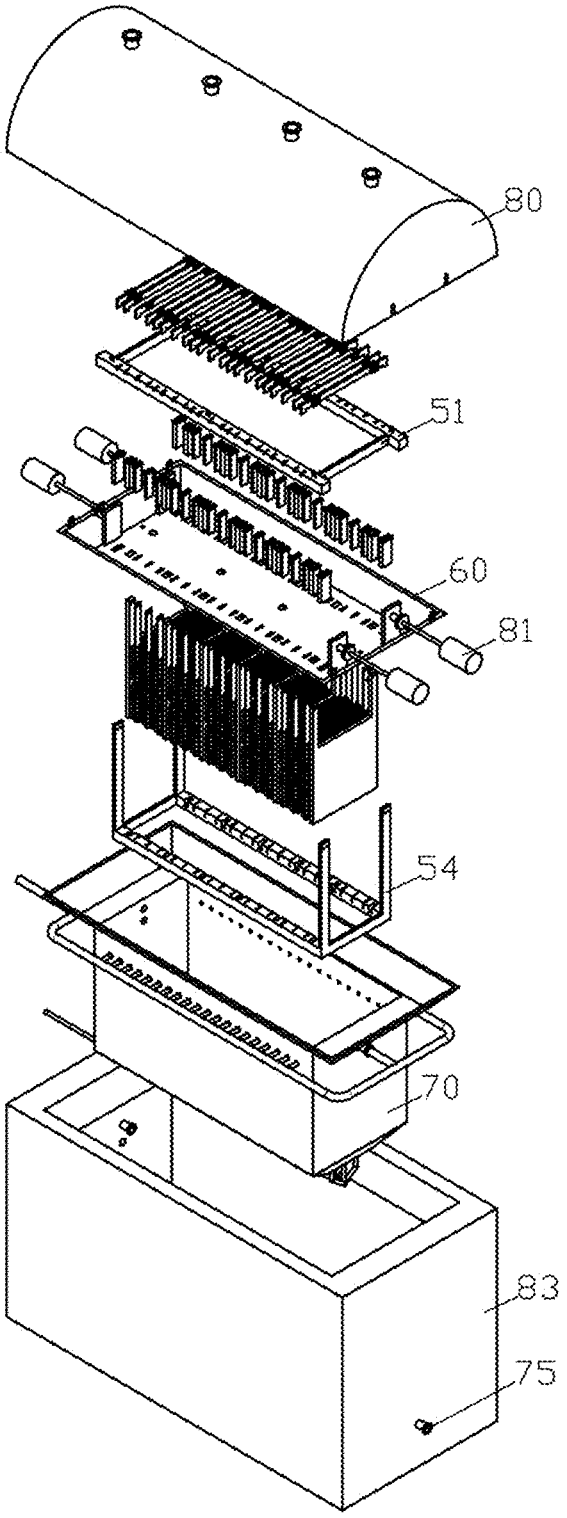
FIG. 27 shows the detailed elaboration of the apparatus according to FIG. 26.

FIG. 26 and FIG. 27 schematically show the proposed apparatus for the electrolytic reduction of feedstock elements, in which the electrolytic cell is additionally provided with six intermediate chambers filled with feedstock elements. All of these intermediate chambers are positioned between the cathode chambers and the anode plates.

The removal of the electrolytic cell 50 with the reduced feedstock elements 10 is made by means of discharging the melt from the electrolyzer bath 70 by pumping the melt or draining it by gravity into another tank followed by cooling of the electrolyzer bath with continuous supply of argon into the electrolyzer bath to prevent oxidation of the final metal. To prevent moisture from reaching the melt residues remaining on the inner surfaces of the electrolyzer bath 70, the electrolytic cell 50 is removed in a room in which humidity is maintained with a dew point of at least −20° C., or advantageously with a dew point of at least −40° C., or further preferably with a dew point of at least −60° C.

Preferably, the reduction method is carried out with stage-by-stage control of current strength and decomposition voltage. For example, when using calcium chloride salt as a melt, and CaO as an active ingredient, the decomposition voltage should be 2.7-2.9 V during the first stage, 2.9-3.0 V during the second stage, 3.0-3.1 V during the third stage, and 3.1-3.2 V during the fourth stage. In this case, it is essential to control the current strength to avoid:

- excessive reduction of the active ingredient, as this can lead to a too high rate of feedstock elements reduction and too fast build-up of reaction products on the surface and in the pores of the feedstock elements up to complete blocking the access of the melt to the internal parts of the feedstock elements;
- deposition of the reduced active ingredient on the surface and in the pores of feedstock elements, provided that the reduced active ingredient has lower solubility in the melt compared to unreduced active ingredient;
- loss of electric current consumption efficiency due to a) contaminating reactions which occur when the reduced active ingredient enters the anode resulting in its subsequent discharge on the anode; or b) development of electronic conductivity of the melt because of too high a concentration of the reduced active ingredient in the melt.

In particular, it is preferable to implement the method of electrolytic reduction of feedstock elements using stage-by-stage control of current strength and decomposition voltage.

In addition, the reduction method requires that the concentration of the active ingredient dissolved in the melt be controlled and kept within the range of 0.05 mol. % and 6.0 mol. %, the values may differ for different stages of the process. Thus, for example, the application WO/2003/038156 states that the concentration range of CaO, which is an active ingredient in the so-called OS process, in the molten salt is usually less than 11.0 wt. %, and the application WO/1999/064638 states that the first part of the process should be carried out with a higher concentration of CaO, which is an active ingredient for the so-called FFC process, and the second part with a lower concentration. As noted by the authors of the present invention, too low concentrations of the active ingredient in the melt can both slow down or block the reduction process, and lead to the extraction, during the electrolysis process, of an oxidized anion of one of the molten salts, in which the cation is identical to the cation of the active ingredient, even at voltages significantly lower than decomposition voltage of the said molten salt. At the same time, due to electrolytic decomposition of the salt, in which the cation is identical to the cation of the active ingredient, the concentration of the active ingredient in the melt increases and if it reaches the solubility limit, this can also slow down or block the further process of electrolytic reduction of feedstock elements due to crystallization of the active ingredient on the surface of feedstock elements and blocking the pores; as a result of which the removal of reduction reaction products from stagnation zones of the melt, both in direct and indirect reduction, as well as the supply of fresh portions of the reduced active ingredient during indirect reduction are slowed down or completely stopped.

The concentration of an active ingredient during electrolytic reduction should be carefully monitored. For example, if it is necessary to increase the concentration of the active ingredient in the melt, a well-milled active ingredient can be added directly into the melt both before the electrolytic reduction process and directly during the process. Before being added the active ingredient must be thoroughly dehydrated for 1-10 hours at temperatures from 200 to 1300° C. and purged with argon to remove air. Feeding the active ingredient to the melt is carried out in argon medium using a metering screw feeder. If it is necessary to reduce the concentration of the active ingredient in case of excessive increase in its concentration in the melt due to, for example, evaporation of part of the melt and/or hydrolysis of the salt, in which the cation is identical to the cation of the active ingredient, because of moisture inclusion, an additional electrolytic cell 90 can be used with an electrolyzer bath into which the melt is pumped from the main bath.

Figure 28:
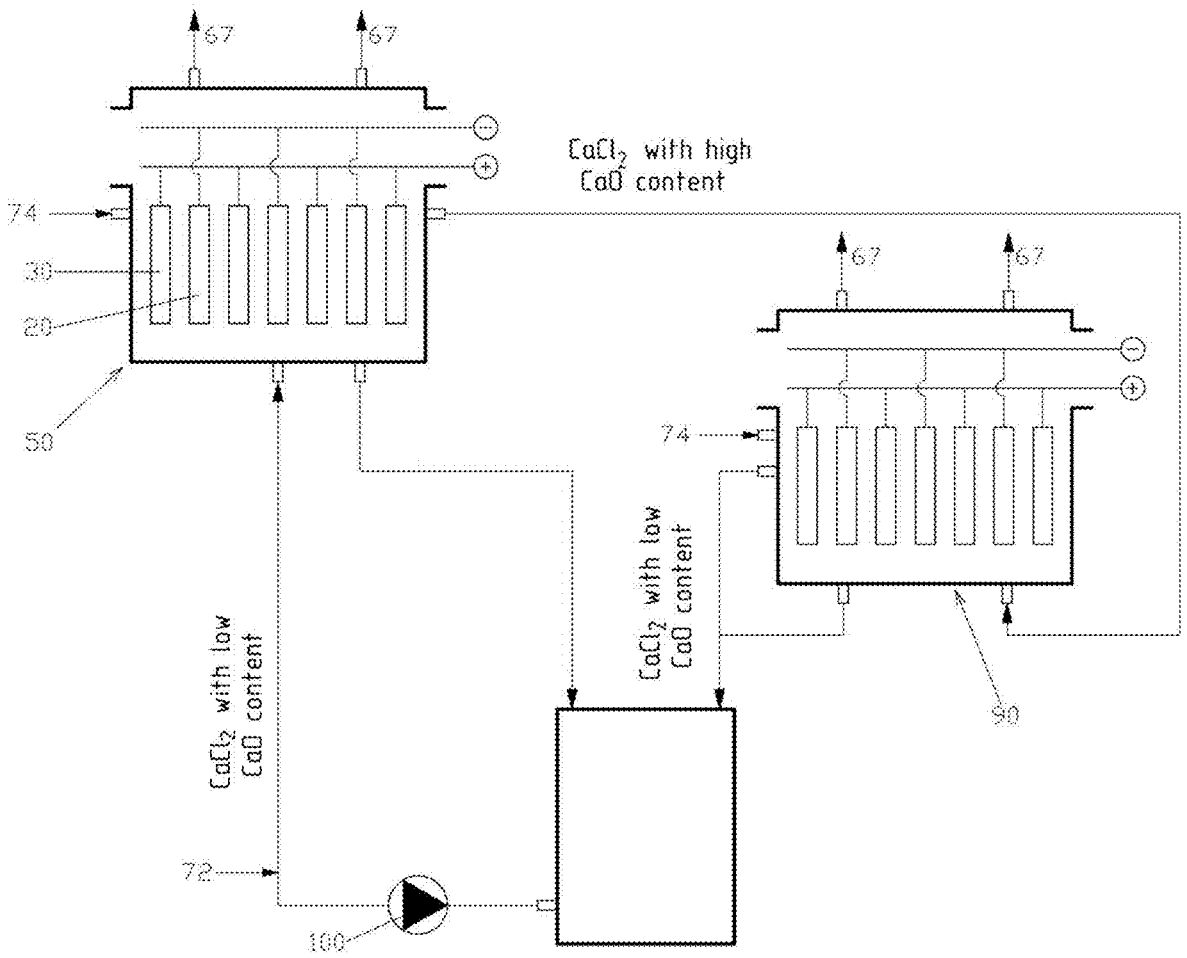
FIG. 28 illustrates one of the possible schematic diagrams for the implementation of an additional electrolytic cell and a bath to control the concentration of the active ingredient in the melt.
Figure 29:
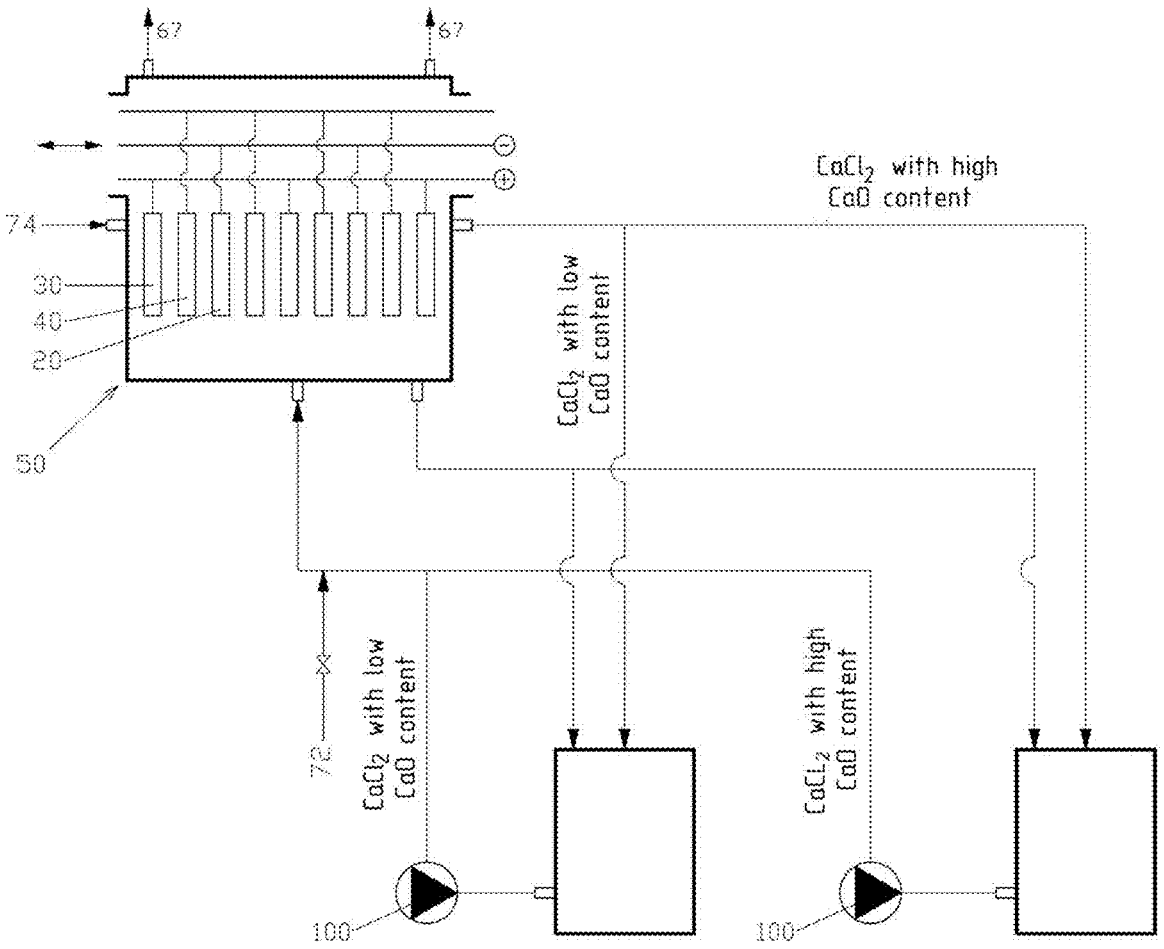
FIG. 29 illustrates a schematic diagram of melts supply into the electrolytic cell.

FIG. 28 illustrates one of the possible schematic diagrams for the implementation of an additional electrolytic cell and a bath to control the concentration of the active ingredient in the melt. The additional electrolytic cell and bath are similar in structure to the main electrolytic cell and bath. In the said additional cell, the cathode chambers are filled with freshly prepared feedstock elements. If it is necessary to reduce the content of the dissolved active ingredient in the melt being pumped, electric current is applied to the electrolytic cell, which initiates the absorption of the active ingredient dissolved in the melt by the cathode material, while the content of the active ingredient in the melt decreases as this process is carried out. Upon reaching the required level of concentration of the active ingredient in the melt, the current supply to the additional electrolytic cell is stopped and the additional electrolytic cell goes into standby mode. When the feedstock elements of the additional electrolytic cell are saturated with the active ingredient in this additional cell, the standard electrolysis process is carried out until the final metal is obtained, thus the cell stops functioning as the additional one used to adjust the content of the active ingredient in the melt, and then it is used as the main one to carry out the process of feedstock elements reduction to the final metal. FIG. 29 shows a schematic diagram of supply of melts (for example, $CaCl_2$) containing various concentrations of the active ingredient (for example, CaO).

Centrifugal-type pumps 100 or other types of pumps capable of withstanding the specified operating conditions, or vacuum pumps, which avoid contact of the pumps themselves with aggressive process environment and high temperatures, can be used to pump molten salts according to the present invention.

The preparation of the melt, namely, its dehydration is crucial for the successful running of the process. Most of the salts used to prepare the melt, such as calcium chloride, are hygroscopic, and the removal of moisture from these salts is an extremely complex process. For example, even when the temperature reaches 800° C., moisture still remains in calcium chloride melt, which according to *Calcium Production by the Electrolysis of Molten $CaCl_2$) Part I. Interaction of Calcium and Copper Calcium Alloy with Electrolyte, Nikolay Shurov, Andrey Suzdaltsev, Article in Metallurgical and Materiarmic Reduction and Simultaneous Electrolysis of CaO in the Molten $CaCl_2$): Some Modifications of OS Prls* leads to $CaCl_2$ hydrolysis to form, as a result, the following compounds according to the following reactions:

$$CaCl_2H_2O = Ca(OH)Cl_{diss} + HCl \quad (6)$$

$$Ca(OH)Cl_{diss} = Ca^{2+} + O^{2-} + HCl \quad (7)$$

$$Ca(OH)Cl_{diss} = Ca^{2+} + OH^{-} + Cl^{-} \quad (8)$$

$$OH + e = \tfrac{1}{2}H_2 + \tfrac{1}{2}O_2 \quad (9)$$

The release of HCl causes heavy corrosion and contributes to the accelerated failure of the equipment, and the presence of moisture in the melt impedes the process of feedstock elements reduction to the final metal.

Below is a brief description of the preferred embodiment of the present invention for the case of using $CaCl_2$) as a melt and CaO as an active ingredient.

Figure 30:
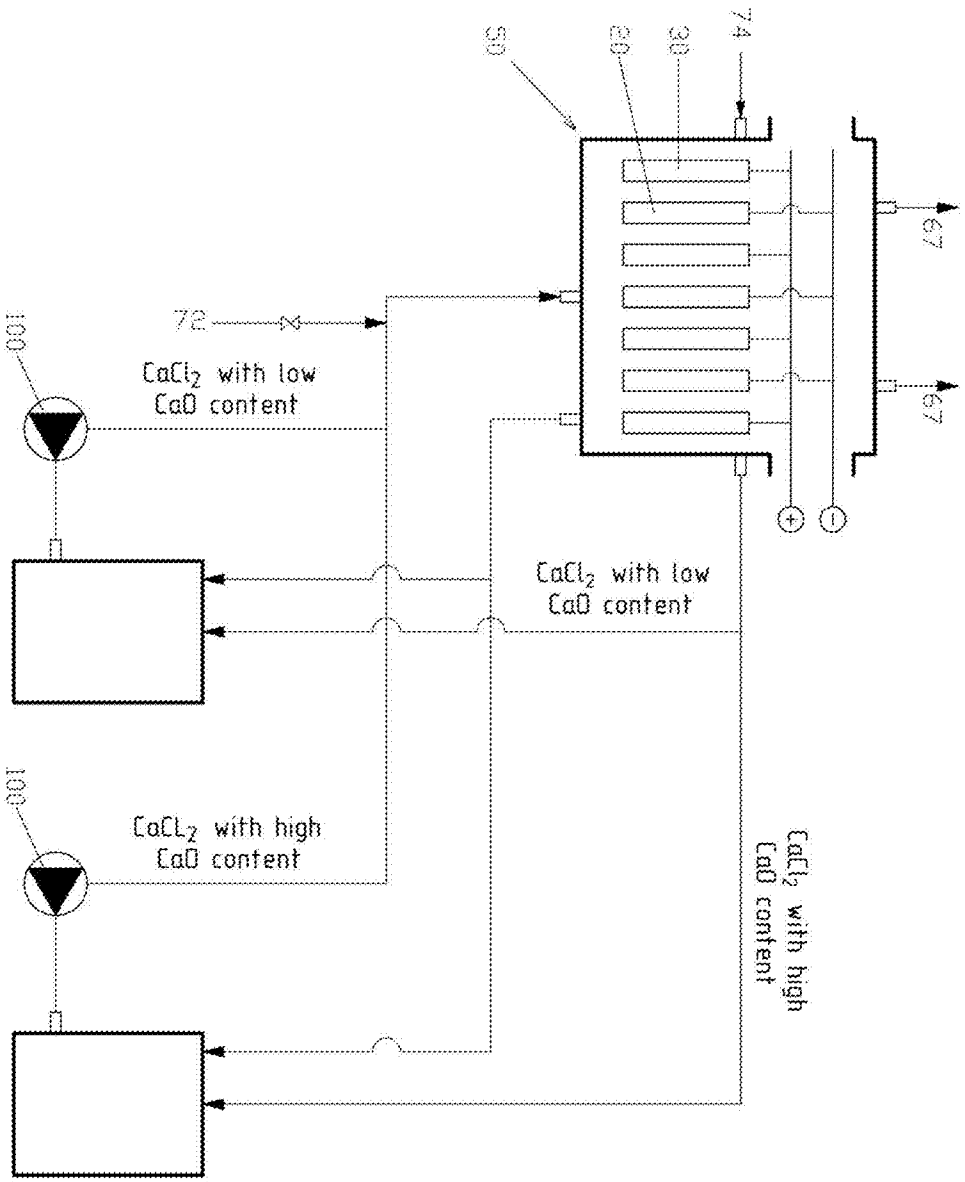
FIG. 30 illustrates one of the possible schematic diagrams with one electrolyzer without an intermediate chamber.

The electrolytic cell is assembled in a separate room, in which humidity is maintained with a dew point of at least −20° C., or advantageously with a dew point of at least −40° C., or further preferably with a dew point of at least −60° C., both with and without an intermediate chamber, with the installation of feedstock elements subjected to electrolytic reduction. After that, the entire electrolytic cell is transferred by means of a lifting mechanism into the electrolyzer, in which the temperature should not exceed 200° C.; the electrolytic cell is installed in the body of electrolyzer bath, which is located in the furnace body, and is closed by the cover, all joints are sealed. After installing the electrolytic cell in the bath, connecting to the current source and sealing, the furnace heating is turned on; the space between the bath body and the heating elements is filled with purified argon, which is then sent into the bath for additional heating of the cell. When the temperature inside the bath where the electrolytic cell is located reaches about 780-850° C. (this is needed to avoid temperature shock and to prevent the cell elements from being exposed to deformation), preliminarily prepared molten salt is fed through the lower inlets. The molten salt is prepared in one of separate units, where the salt is dehydrated, brought to a temperature of 850-1100° C. and pumped into the electrolyzer bath through a pump. The filling of the bath should be slow so that all elements of the cell are warmed evenly. After the bath has been filled with molten salt and the melt has overflowed into the initial tank with the temperature at the bath outlet having achieved 850-1100° C., electric current is applied to the cathode chambers to provide a decomposition voltage in the range of 2.7-3.2 V for each cell element. To provide process control, electric current is applied independently to each cathode chamber. During the electrolytic reduction process there occurs evolution of gases, which are removed for further cleaning and extraction of argon, which is then sent to the process again after purification and drying. At the electrolyzer outlet, the CaO concentration is carefully monitored, if in the first phase of the process the CaO concentration in the salt at the electrolyzer outlet falls below 0.2 mol. %, the concentration in the melt is adjusted by means of additional supply of CaO preliminarily prepared in the salt preparation unit. As soon as the first phase of the process is completed, the absorption of CaO, dissolved in the melt, by feedstock elements ceases, and the process proceeds to the next phase, which is characterized by the release of calcium absorbed in the previous stage in the form of CaO from the feedstock elements (see FIG. 30). At this stage, for additional release of CaO from the feedstock elements, reciprocating movement of the entire cell is provided at a speed of 0.1-3.0 cm/sec. The frequency of horizontal movement of the electrolytic cell is 1-48 movements within 24 hours during the entire deoxidation process, while the concentration of CaO in the melt is carefully controlled; the concentration of CaO in the melt should not exceed 6 mol. %.

When the release of CaO from the feedstock elements ceases, the next phase of the deoxidation process begins. At this stage, the supply of high CaO melt into the electrolyzer is stopped, the remaining salt is drained from the electrolyzer by gravity into the initial tank, and the lines are purged with hot argon at a temperature of at least 800° C., after which the supply of low CaO melt from the other tank is started.

In case of using an intermediate chamber the process is similar.

After the reduction process is over, the molten salt is drained into the initial tank by gravity and the melt supply line is blown with hot argon with a temperature of at least 800° C. The current supply to the cell elements is stopped and the heating of the furnace in which the bath with the electrolytic cell is located is turned off. Cooled argon is supplied to the bath to cool the electrolytic cell to a temperature of 100-200° C. After cooling, the electrolyzer cover is removed and, using the lifting mechanism, the cell is transferred into a room with dehydrated air, where graphite anode plates are removed from the cell first. Then, the anode plates are evaluated for possible reuse, and the cathode chambers remaining in the frame are freed from reduced feedstock elements. After removal, the reduced feedstock elements are sent for washing to remove salts and further processing.

In case of using an intermediate chamber, the intermediate chamber with feedstock elements is reinstalled in a newly formed cell for a new deoxidation process, in which it will act as a cathode chamber. The process using an intermediate chamber can improve the efficiency of current consumption by reducing contaminating reactions.

Figure 31:
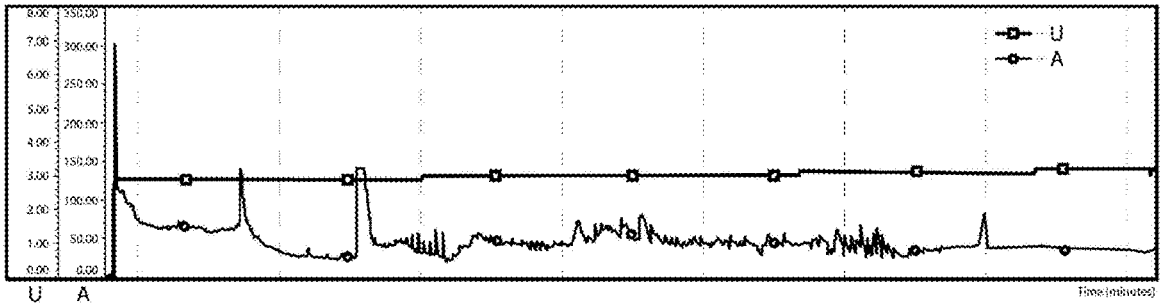
FIG. 31 shows a typical diagram of the process of $TiO_2$ deoxidation in molten $CaCl_2$) salt in the presence of CaO as an active ingredient.

FIG. 31 shows a typical diagram of a TiO2 deoxidation process in a molten $CaCl_2$) salt in the presence of CaO as an active ingredient according to the present invention.

EXAMPLES

Example 1

At room temperature, the electrolytic cell consisting of two cathode chambers and three graphite anode plates is placed into the electrolyzer bath using a lifting mechanism, the cathode chambers containing feedstock elements to be reduced, preliminarily arranged in the cathode chambers in an orderly manner. The weight of feedstock elements loaded into the cathode chambers was 12 kg (6 kg per each cathode chamber). The feedstock elements are made of titanium dioxide with 99.5 wt. % $TiO_2$ content and primary particle sizes in the range of 15-20 μm. The feedstock elements are mechanically strong hollow cylinders with a circular cross section. The length of feedstock elements is 50 mm; the feedstock elements have an outer diameter of 35 mm, a wall thickness of 5 mm and a wall porosity of 60-65 vol. %. One cathode chamber and one anode plate are connected to one independent electric current source, and the other cathode chamber and two other anode plates are connected to another independent electric current source. The electrolyzer is sealed. After that, hot argon is supplied through the lower melt supply system and external heating of the electrolyzer in a furnace is started (this procedure is necessary to avoid the temperature shock of all parts of the electrolytic cell). When the temperature in the electrolyzer bath reaches 850° C., the flow of hot argon is stopped and $CaCl_2$ molten salt at a temperature of 850° C. is fed into the bath through the lower feed system until the entire cathode and anode system is completely immersed in the molten salt. After this, the molten salt supply is stopped; the total amount of melt in the electrolyzer bath is 300 kg. From this moment on, argon is supplied into the upper part of the bath in such a way that it enters the free space above the molten salt. The $CaCl_2$ salt melt is prepared in a separate salt preparation unit and pumped into the electrolyzer using a centrifugal pump. When the electrolyzer bath reaches a temperature of 900° C., electric current is applied to each cathode chamber from independent sources during the first 56 hours with a voltage of 2.9 V, then for the next 56 hours with a voltage of 3.0 V and for the last 56 hours with a voltage of 3.1 V. The gases evolved during the reduction process are sent to the scrubber system for cleaning. After a total of 168 hours, the supply of electric current is stopped, the melt is discharged into the initial tank, the heating in the furnace is turned off, and cold argon at a temperature of 20° C. is supplied to the electrolyzer bath to cool the electrolytic cell to a temperature of 50° C., after which the electrolyzer is opened and the electrolytic cell containing feedstock elements, subjected to reduction, is transferred into a separate room, in which humidity is maintained with a dew point of at least −60° C., where the cell is disassembled and the reduced feedstock elements are subsequently removed from the cathode chambers. After removal, the feedstock elements are washed with water to dissolve and remove $CaCl_2$ salt residues, and wet-milled in a bead mill; the resulting final metal powder is then separated from water and washed with 1 wt. % hydrochloric acid solution to dissolve CaO residues deposited at the surface of feedstock elements, and then washed again with water to remove residual acid, washed from acid and acid reaction products and CaO, dried at 150° C. for 3 hours and subjected to chemical analysis for titanium content using a Rigaku Supermini200 wavelength dispersive X-ray fluorescence spectrometer, and for oxygen content using ELTRA ON 900 analyzer determining gases in inorganic samples. The results of feedstock elements reduction to the final metal in the cathode chambers are shown in Table 1.

Example 2

The same reduction procedure as described in Example 1 is followed, except that the electric current is supplied with a voltage of 3.1 V during the whole process, that is, for 168 hours. The results of feedstock elements reduction to the final metal in the cathode chambers are shown in Table 1.

Example 3

The same reduction procedure as described in Example 1 is followed, except that calcium oxide was preliminarily added into the melt in the salt preparation unit, in the amount of 0.5 mol. %. The results of feedstock elements reduction to the final metal in the cathode chambers are shown in Table 1.

Example 4

The same reduction procedure as described in Example 3 is followed, except that, 48 hours after the start of the electrolysis process, the procedure of horizontal movement of the electrolytic cell begins at a speed of 0.2 cm/sec with a frequency of once in 6 hours. The results of feedstock elements reduction to the final metal in the cathode chambers are shown in Table 1.

Example 5

The same reduction procedure as described in Example 4 is followed, except that the melt is pumped through the electrolyzer bath at a rate of 10 l/min for every 100 l of the melt volume in the electrolyzer bath. The results of feedstock elements reduction to the final metal in the cathode chambers are shown in Table 1.

Example 6

The same reduction procedure as described in Example 5 is followed, except that the temperature of the melt is 950° C. The results of feedstock elements reduction to the final metal in the cathode chambers are shown in Table 1.

Example 7

The same reduction procedure as described in Example 5 is followed, except that the concentration of CaO dissolved in the melt is 1.5 mol. %. The results of feedstock elements reduction to the final metal in the cathode chambers are shown in Table 1.

Example 8

The same reduction procedure as described in Example 5 is followed, except that between the cathode chambers and the anode plates there are four intermediate chambers with pre-installed feedstock elements similar to the feedstock elements loaded into the cathode chambers in Example 1. The weight of the feedstock elements loaded into the intermediate chambers is 24 kg (6 kg per each intermediate chamber). No electric current is supplied to the intermediate chambers. The results of feedstock elements reduction to the final metal in the cathode chambers are shown in Table 1.

Example 9

The same reduction procedure as described in Example 8 is followed, except that the reduction during the first 40 hours was carried out with a voltage of 2.9 V, during the next 40 hours with a voltage of 3.0 V and during the last 40 hours with a voltage of 3.1 V. The results of feedstock elements reduction to the final metal in the cathode chambers are shown in Table 1.

Example 10

The same reduction procedure as described in Example 9 is followed, except that after the first 24 hours the procedure of horizontal movement of the electrolytic cell begins at a speed of 0.2 cm/sec with a frequency of once in 4 hours. The results of feedstock elements reduction to the final metal in the cathode chambers are shown in Table 1.

Example 11

The same reduction procedure as described in Example 10 is followed, except that the reduction during the first 20 hours was carried out with a voltage of 2.9 V, during the next 20 hours with a voltage of 3.0 V and during the last 20 hours with a voltage of 3.1 V. The results of feedstock elements reduction to the final metal in the cathode chambers are shown in Table 1.

Example 12

The same reduction procedure as described in Example 11 is followed, except that the concentration of CaO dissolved in the melt is 1.5 mol. %. The results of feedstock elements reduction to the final metal in the cathode chambers are shown in Table 1.

Example 13

The same reduction procedure as described in Example 12 is followed, except that intermediate chambers filled with feedstock elements having been subjected to one cycle of the reduction process from Example 12, were used as cathode chambers. The results of feedstock elements reduction to the final metal in the cathode chambers are shown in Table 1.

Example 14

The same reduction procedure as described in Example 13 is followed, except that 24 hours after the start of the process, the melt pumped through the electrolyzer was replaced by the new melt, in which the CaO content was 0.2 mol. %, and which had been prepared separately in the salt preparation unit by controlled addition of CaO to the melt. The results of feedstock elements reduction to the final metal in the cathode chambers are shown in Table 1.

Example 15

The same reduction procedure as described in Example 14 is followed, except that an electrolytic cell consisting of six cathode chambers and seven graphite anode plates is placed in the electrolyzer bath. Five cathode chambers and five anode plates are connected to five independent electric current sources, the sixth cathode chamber and the sixth and seventh anode plates are connected to the sixth independent electric current source. Between the cathode chambers and the anode plates there are twelve intermediate chambers with feedstock elements which were preliminarily installed in these intermediate chambers, the feedstock elements being similar to the feedstock elements loaded into the cathode chambers in Example 1. The weight of the feedstock elements loaded into the intermediate chambers is 72 kg (6 kg in each intermediate chamber). The results of feedstock elements reduction to the final metal in the cathode chambers are shown in Table 1.

Example 16

The same reduction procedure as described in Example 14 is followed, except that the melt with CaO content of 0.2 mol. % is prepared in an additional electrolytic cell by pumping the melt from the main cell through an additional cell and provided that the first third of the reduction process takes place in the additional cell, that is the first 20 hours at a voltage of 2.9 V, which is accompanied by the absorption of CaO from the melt. The design of the additional electrolytic cell is similar to the design of the main electrolytic cell. The results of feedstock elements reduction to the final metal in the cathode chambers are shown in Table 1.

Example 17

The same reduction procedure as described in Example 12 is followed, except that the additional electrolytic cell which has gone through the first third of the reduction process, that is the first 20 hours at a voltage of 2.9 V, as described in Example 16, is used as an electrolytic cell, respectively, the reduction of feedstock elements of this cell when using it as the main cell is carried out during 20 hours with a voltage of 3.0 V, and the next 20 hours with a voltage of 3.1 V. The results of feedstock elements reduction to the final metal in the cathode chambers are shown in Table 1.

TABLE 1

Analysis Results for Feedstock Elements Reduced to Final Metal

| Example # | Content of Ti in the Final Metal (wt. %) | Content of O in the Final Metal (wt. %) |
|---|---|---|
| 1 | 80.5 | 19.0 |
| 2 | 78.2 | 21.3 |
| 3 | 88.4 | 11.1 |
| 4 | 93.2 | 6.3 |
| 5 | 95.0 | 4.5 |
| 6 | 95.9 | 3.6 |
| 7 | 96.0 | 3.5 |
| 8 | 92.0 | 7.5 |
| 9 | 89.2 | 10.3 |
| 10 | 90.7 | 8.8 |
| 11 | 87.4 | 12.1 |
| 12 | 94.5 | 5.0 |
| 13 | 98.5 | 1.0 |
| 14 | 99.3 | 0.15 |
| 15 | 99.3 | 0.14 |
| 16 | 99.3 | 0.16 |
| 17 | 99.3 | 0.17 |

The present invention has been described above with reference to numerous examples and embodiments thereof, which are used only as illustrations thereof and in no way limit the scope of the invention.

Despite the fact that the present description contains numerous characteristic features, these features should not be construed as limiting the scope of the present invention, but as merely illustrating advantageous embodiments of the present invention, as well as the preferred embodiment of the present invention contemplated by the inventors for implementing the present invention. The present invention in accordance with the description given in this document allows various changes and additions that are obvious to experts in the field of technology to which the present invention relates.

LIST OF NUMERICAL DESIGNATIONS USED IN THE PRESENT INVENTION

10—Feedstock elements;

11—Feedstock elements shaped as hollow cylinders with a circular cross section;

12—Feedstock elements shaped as hollow cylinders with an oval-shaped cross section;

13—Feedstock elements shaped as tubes with a triangular cross section;
14—Feedstock elements shaped as tubes with a rectangular cross section;
15—Feedstock elements shaped as tubes with a square cross section;
20—Cathode chamber;
21—Suspension rods for feedstock elements;
22—Fixing brackets for feedstock elements;
23—Stiffeners;
24—Strips;
25—Bolted connections;
30—Anode plate;
31—Anode plate strips;
32—Bolted connection;
40—Intermediate chamber;
41—Additional slots;
50—Electrolytic cell;
51—Upper part of the electrolytic cell supporting frame;
52—Slots for mounting and fixing the cathodes;
53—Slots for mounting and fixing the anodes;
54—Lower part of the supporting frame;
55—Fixing slots for the anode;
56—Fixing slots for the cathode;
57—Bolted connection;
58—Mounting loops;
59—Contact relay terminals;
60—Electrolyzer bath insert plate;
61—Holes in the insert plate;
62—Protective cases;
63—Ceramic cases;
64—Support plates;
65—Hole for the installation of thermocouples;
66—Hole for the installation of thermocouples;
67—Evolved gas outlets;
68—Additional holes in the electrolyzer bath insert plate;
70—Electrolyzer bath;
71—Pipelines connection;
72—Supply of hot or cold argon into the melt supply line;
73—Molten salt outlets;
74—Hot or cold argon inlet;
75—Argon supply in the lower part;
80—Electrolyzer cover;
81—Pushers;
82—Evolved gas outlets;
83—Body of the furnace;
84—Heating elements;
90—Additional electrolytic cell;
100—Pumps.

The invention claimed is:

1. A method for electrolytic reduction of feedstock elements made from feedstock in a melt by electrolysis in at least one electrolytic cell containing the said melt, at least one cathode chamber and two anode plates that are vertically arranged relative to each other, providing:

an ordered arrangement of feedstock elements;

constant current supply to each of the orderly arranged feedstock elements during the reduction method using at least one current source, independently connected to the cathode chamber and to one or two anode plates and the reduction method is carried out with stage-by-stage control of current strength and decomposition voltage;

feed of the melt into the space between the cathode chamber and the anode plates and flow of the melt through the pores of the feedstock elements;

supply of fresh portions of the active ingredient;

removal of gases evolved at the anode plate without their contact with the cathode chamber and the feedstock elements placed in it;

main and additional heating of the indicated electrolytic cell;

horizontal reciprocating movement of the electrolytic cell is performed at a speed of 0.1-3.0 cm/sec and with a horizontal movement period of 1-48 movements within 24 hours during the entire deoxidation process;

simultaneous supply of fresh portions of the reduced active ingredient and removal of reaction products from stagnation zones of the melt;

removal of reduced feedstock elements under controlled conditions.

2. The method according to claim 1, wherein the electrolytic cell is additionally provided with at least one intermediate chamber without supplying electric current to it, the intermediate chamber being filled with feedstock elements and located between the cathode chamber and the anode plate.

3. The method according to claim 1, wherein an additional electrolytic cell is used.

4. The method according to claim 1, wherein the reduction of feedstock elements is carried out at a concentration in the range from 0.05 mol. % to 6.0 mol. % of the active ingredient, dissolved in the melt.

5. The method according to claim 1, wherein the reduction of feedstock elements is carried out using CaO as an active ingredient, the concentration of which in the melt is 6 mol. % at most.

6. The method according to claim 1, wherein feedstock containing 97.0-99.9 wt. % of metal oxide or a mixture of metal oxides, advantageously 98.0-99.9 wt. %, optimally 99.5-99.9 wt. % is used for the formation of feedstock.

7. The method according to claim 6, wherein the particle sizes of the feedstock used to form feedstock elements to be reduced fall within the range of 0.1-100.0 μm, advantageously 10.0-90.0 μm, or further preferably 15.0-60.0 μm.

8. The method according to claim 7, wherein feedstock elements shaped as hollow cylinders with round or oval cross section, or tubes with triangular or rectangular (14), or square cross section are used.

9. The method according to claim 8, wherein feedstock elements have length between 1 and 100 mm, advantageously between 10 and 90 mm, or further preferably between 25 and 50 mm.

10. The method according to claim 9, wherein wall thickness of feedstock elements is 1-25 mm.

11. The method according to claim 10, wherein feedstock elements with a wall thickness of 1-8 mm have a wall porosity of 20-70 vol. %, advantageously 40-70 vol. %, optimally 55-65 vol. %, and feedstock elements with a wall thickness of 9-25 mm have a porosity of 55-85 vol. %, advantageously 60-80 vol. %, optimally 65-75 vol. %.

* * * * *